US010598446B2

(12) United States Patent
Saiwai et al.

(10) Patent No.: US 10,598,446 B2
(45) Date of Patent: Mar. 24, 2020

(54) POROUS ALUMINUM HEAT EXCHANGE MEMBER

(71) Applicant: MITSUBISHI MATERIALS CORPORATION, Tokyo (JP)

(72) Inventors: Toshihiko Saiwai, Kitamoto (JP); Koichi Kita, Kitamoto (JP); Ji-bin Yang, Kitamoto (JP); Koji Hoshino, Kitamoto (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 53 days.

(21) Appl. No.: 15/322,507

(22) PCT Filed: Jul. 2, 2015

(86) PCT No.: PCT/JP2015/069095
§ 371 (c)(1),
(2) Date: Dec. 28, 2016

(87) PCT Pub. No.: WO2016/002870
PCT Pub. Date: Jan. 7, 2016

(65) Prior Publication Data

US 2017/0153072 A1 Jun. 1, 2017

(30) Foreign Application Priority Data

Jul. 2, 2014 (JP) ..... 2014-137156

(51) Int. Cl.
*F28F 21/08* (2006.01)
*F28D 15/04* (2006.01)
(Continued)

(52) U.S. Cl.
CPC ..... *F28F 21/08* (2013.01); *F28D 15/02* (2013.01); *F28D 15/0266* (2013.01);
(Continued)

(58) Field of Classification Search
CPC ..... F28D 15/043; F28D 15/046; F28D 15/02; F28D 15/025; F28D 15/0266; F28D 15/0275; F28F 13/003; F28F 13/185
(Continued)

(56) References Cited

U.S. PATENT DOCUMENTS 4,042,163 A 8/1977 Schladitz
2006/0196641 A1* 9/2006 Hong ..... F28D 15/046 165/104.26
(Continued)

FOREIGN PATENT DOCUMENTS

CA 1176490 A 10/1984
CN 87107184 A 8/1988
(Continued)

OTHER PUBLICATIONS

Translation of Japanese Patent Document JP2011007365A entitled Translation-JP2011007365A (Year: 2019).*
(Continued)

*Primary Examiner* — Paul Alvare
(74) *Attorney, Agent, or Firm* — Locke Lord LLP

(57) ABSTRACT

A porous aluminum heat exchanger including: a porous aluminum body in which aluminum substrates are sintered each other; and a bulk body, which is an aluminum bulk body made of aluminum or aluminum alloy is provided. Pillar-shaped protrusions projecting toward an outside are formed on outer surfaces of the aluminum substrates, and pores of the porous aluminum body are configured to form flow channels of a heat medium.

10 Claims, 14 Drawing Sheets

(51) Int. Cl.
*F28D 15/02* (2006.01)
*F28F 13/00* (2006.01)
*F28F 13/18* (2006.01)

(52) U.S. Cl.
CPC ..... *F28D 15/046* (2013.01); *F28F 21/084* (2013.01); *F28F 13/003* (2013.01); *F28F 13/185* (2013.01)

(58) Field of Classification Search
USPC ..... 165/133, 181, 104.26
See application file for complete search history.

(56) References Cited

U.S. PATENT DOCUMENTS

| | | | | |
|---|---|---|---|---|
| 2006/0198753 | A1* | 9/2006 | Hong | B22F 1/0014 419/23 |
| 2007/0077165 | A1* | 4/2007 | Hou | B22F 1/0003 419/32 |
| 2007/0084587 | A1* | 4/2007 | Huang | B22F 5/106 165/104.26 |
| 2007/0089860 | A1* | 4/2007 | Hou | B22F 1/0011 165/80.4 |
| 2009/0269521 | A1* | 10/2009 | Tuma | C23C 18/08 428/32.74 |
| 2010/0181048 | A1* | 7/2010 | Hwang | F28D 15/0233 165/104.26 |
| 2010/0294475 | A1* | 11/2010 | Rush | B22F 3/1121 165/185 |
| 2011/0127013 | A1* | 6/2011 | Kawamura | B22F 7/08 165/104.26 |
| 2012/0094142 | A1 | 4/2012 | Hoshino et al. | |
| 2012/0135142 | A1* | 5/2012 | Yang | B22F 3/1125 427/247 |
| 2014/0186652 | A1 | 7/2014 | Poggi | |

FOREIGN PATENT DOCUMENTS

| | | | | | |
|---|---|---|---|---|---|
| CN | 101294776 | A | | 10/2008 | |
| CN | 102365143 | A | | 2/2012 | |
| JP | 51-045358 | A | | 4/1976 | |
| JP | 55-024937 | A | | 2/1980 | |
| JP | 56-077301 | A | | 6/1981 | |
| JP | 56-149363 | A | | 11/1981 | |
| JP | H03-110045 | A | | 5/1991 | |
| JP | 08-325661 | A | | 12/1996 | |
| JP | 2006-300395 | A | | 11/2006 | |
| JP | 2007-056302 | A | | 3/2007 | |
| JP | 2007-147194 | A | | 6/2007 | |
| JP | 2009-263182 | A | | 11/2009 | |
| JP | 2010-255089 | A | | 11/2010 | |
| JP | 2010-280951 | A | | 12/2010 | |
| JP | 2011-007365 | A | | 1/2011 | |
| JP | 2011007365 | A | * | 1/2011 | F28D 15/046 |
| JP | 2011-214046 | A | | 10/2011 | |
| JP | 5594445 | B1 | | 9/2014 | |
| JP | 5633658 | B2 | | 12/2014 | |
| JP | 2015-151609 | A | | 8/2015 | |
| WO | 2012/160275 | A1 | | 11/2012 | |
| WO | 2015/174541 | A1 | | 11/2015 | |
| WO | 2015/174542 | A1 | | 11/2015 | |
| WO | 2015/182783 | A1 | | 12/2015 | |

OTHER PUBLICATIONS

Internatinal Search Report dated Sep. 1, 2015, issued for PCT/JP2015/069095.
Notice of Allowance dated Oct. 3, 2017, issued for the Japanese patent application No. 2014-137156 and English translation thereof.
Office Action dated Mar. 2, 2018, issued for the Chinese patent application No. 201580032177.2 and English translation thereof.
Office Action dated Aug. 24, 2018 issued for corresponding Chinese Patent Application No. 201580032177.2.

* cited by examiner

POROUS ALUMINUM HEAT EXCHANGE MEMBER

TECHNICAL FIELD

The present invention relates to a porous aluminum heat exchanger for performing heat exchange with a heat medium by using porous aluminum.

Priority is claimed on Japanese Patent Application No. 2014-137156, filed Jul. 2, 2014, the content of which is incorporated herein by reference.

BACKGROUND ART

The heat exchanger is used for exchanging heat energy between two fluids having different heat energy such as between the refrigerant gas and air. More specifically, it is used broadly for heating, cooling, evaporating, and condensing of the fluids by transferring heat efficiently from an object having high temperature to an object having low temperature. For example, such an heat exchanger is installed in the steam generator and the condenser of the boiler; in the indoor unit and the discharger of the air conditioner; in the radiator of the automotive part; and the like.

The heat pipe, which is an example of such a heat exchanger, is capable of heating or cooling the other fluid around the pipe such as air by tubing one fluid such as liquefied refrigerant gas in the pipe as a heat medium; and generating a heat cycle of evaporation (absorption of the latent heat) and condensation (release of the latent heat) of the refrigerant gas. In the process of this heat cycle, the other fluid performs heat transport.

At this time, by forming fine grooves in the pipe, the heat medium can be transferred by utilizing the capillary force of these fine grooves even in the absence of height difference between the one end (evaporating side) and the other end (condensing side) of the pipe, for example (refer Patent Literature 1 (PTL 1), for example).

In addition, a configuration, in which the heat medium is retained and transferred in the pipe by utilizing the capillary force between the fibers by laying braided fibers called the wick in the pipe, is known (refer Patent Literature 2 (PTL 2), for example).

In addition, a configuration, in which the heat medium is transferred by utilizing the capillary force between the fibers while a certain amount of the heat medium retained by laying sintered aluminum fibers in the pipe, is known (refer Patent Literature 3 (PTL 3), for example).

CITATION LIST

Patent Literature

PTL 1: Japanese Unexamined Patent Application, First Publication No. 2007-147194 (A)

PTL 2: Japanese Unexamined Patent Application, First Publication No. 2006-300395 (A)

PTL 3: Japanese Unexamined Patent Application, First Publication No. 2011-007365 (A)

SUMMARY OF INVENTION

Technical Problem

However, the heat pipe disclosed in PTL 1 has a problem that the amount of the heat medium retained is limited since there is a strong limitation for the length of the grooves formed in the pipe.

In addition, the heat pipe disclosed in PTL 2 has a problem that heat transfer cannot be performed efficiently between the pipe and the heat medium retained by the fibers since the inner wall of the pipe and the fibers only form contacting parts in a linear shape.

In addition, in the heat pipe disclosed in PTL 3, the aluminum fibers are used for retaining the heat medium. However, there is a need for increasing the compression ratio of the aluminum fibers to increase the capillary force of the aluminum fibers. However, the heat pipe disclosed in PTL 3 has a problem that the holding force of the heat medium is reduced since the porosity of the aluminum fibers is reduced adversely by increasing the compression ratio.

In addition, when the heat medium includes water, hydrophilicity impartation processing is needed on the surface of the aluminum fibers since the surface of the aluminum fibers has inferior wettability. Such an extra processing increases the production cost.

The present invention is made under the circumstances explained above. The purpose of the present invention is to provide a porous aluminum heat exchanger having high holding ability of the heat medium and excellent thermal conductivity, which is capable of being produced at low cost.

Solution to Problem

In order to achieve the purpose by solving the above-mentioned technical problems, the present invention has aspects explained below. An aspect of the present invention is a porous aluminum heat exchanger (hereinafter, referred as "the porous aluminum heat exchanger of the present invention") including: a porous aluminum body in which aluminum substrates are sintered each other; and a bulk body made of metal or metal alloy, wherein pillar-shaped protrusions projecting toward an outside are formed on outer surfaces of the aluminum substrates, and pores of the porous aluminum body are configured to form flow channels of a heat medium.

According to the porous aluminum heat exchanger of the present invention, microscopic spaces are formed without increasing the compression ratio by using the sintered compact of the aluminum substrates, on surfaces of which pillar-shaped protrusions are formed, as the porous aluminum body constituting the porous aluminum heat exchanger. Thus, the capillary force can be increased. Because of this, heat exchange can be performed efficiently by the porous aluminum body.

In addition, the holding ability of the heat medium is increased in the porous aluminum body since the capillary force is increased without increasing the compression ratio in the porous aluminum body. Thus, heat exchange in a large volume can be performed.

Furthermore, a number of the pillar-shaped protrusions are formed on the surfaces of the porous aluminum body; and a high capillary force is obtained by the microscopic spaces formed with the pillar-shaped protrusions. Thus, the heat medium is absorbed efficiently and retained without hydrophilic treatment imparting hydrophilicity to the surface of the porous aluminum body. As a result, no cost is needed for the hydrophilic treatment, and the porous aluminum heat exchanger can be produced at low cost.

In the porous aluminum heat exchanger of the present invention, the bulk body may be an aluminum bulk body made of aluminum or aluminum alloy.

By having the above-described configuration, the porous aluminum heat exchanger, which is formed in one-piece by sintering the porous aluminum body and the aluminum bulk body, can be produced.

In the porous aluminum heat exchanger of the present invention, a substrate junction, in which the aluminum substrates are bonded each other, may include a Ti—Al compound, and the substrate junction may be formed on the pillar-shaped protrusions.

By having the above-described configuration, the capillary force is further increased since a number of microscopic spaces are secured in the porous aluminum body. Thus, the holding ability of the heat medium is increased in the porous aluminum body, making it possible to perform heat exchange efficiently. In addition, the bonding strength between each of porous aluminum substrates can be improved significantly since the substrate junction includes the Ti—Al compound. In addition, invasion of melted aluminum into the porous part can be suppressed since the melt flow of aluminum is suppressed by the Ti—Al compound. Thus, a high porosity can be secured in the porous aluminum body.

In the porous aluminum heat exchanger of the present invention, a specific surface area of the porous aluminum body may be 0.020 $m^2/g$ or more, and a porosity of the porous aluminum body may be in a range of 30% or more and 90% or less.

In the porous aluminum body configured as explained above, the specific surface area of the porous aluminum body is set to 0.020 $m^2/g$ or more. Accordingly, it has a large surface area per the unit mass, making it possible to perform heat exchange efficiently by increasing the holding ability of the heat medium. In addition, in the porous aluminum body configured as explained above, the porosity of the porous aluminum body is set in a range of 30% or more and 90% or less. Thus, the porous aluminum heat exchanger having the optimum porosity depending on the application can be provided.

In the porous aluminum heat exchanger of the present invention, the aluminum bulk body may be an aluminum pipe.

By using the aluminum pipe as the aluminum bulk body, the fluid holding heat energy for evaporating or condensing the heat medium can be circulated efficiently. In addition, heat exchange between the fluid and the heat medium can be performed efficiently by the high thermal conductivity of aluminum.

In the porous aluminum heat exchanger of the present invention, the aluminum substrates may be one of or both of aluminum fibers and an aluminum powder.

By using one of or both of aluminum fibers and an aluminum powder as the aluminum substrates, a number of microscopic spaces are secured in the porous aluminum body and the capillary force is increased. Thus, the holding ability of the heat medium in the porous aluminum body is increased, making it possible for heat exchange to be performed efficiently. In addition, the porous aluminum body in any shape can be obtained easily during formation of the porous aluminum body from the aluminum substrates.

In the porous aluminum heat exchanger of the present invention, the porous aluminum body and the aluminum bulk body may form one-piece part in which the porous aluminum body and the aluminum bulk body are bonded each other by sintering.

Because of this, the porous aluminum heat exchanger can be used as an entirely integrated single block part. Accordingly, ease of handling of the porous aluminum heat exchanger during installation into a larger machine can be improved. At the same time, thermal resistance at the bonding interface is low, since the porous aluminum body and the aluminum bulk body are bonded metallically. Thus, heat exchange can be performed efficiently.

In the porous aluminum heat exchanger of the present invention, a junction, in which the aluminum substrates and the aluminum bulk body are bonded, may include a Ti—Al compound, and the junction is formed on the pillar-shaped protrusions.

Because of this, the porous aluminum substrates and the aluminum bulk body can be used as an integrated single block part by high bonding strength. In addition, the bonding strength between the aluminum substrates and the aluminum bulk body can be improved significantly since the junction, in which the aluminum substrates and the aluminum bulk body are bonded, includes the Ti—Al compound,

Advantageous Effects of Invention

According to the porous aluminum heat exchanger of the present invention, a porous aluminum heat exchanger having high holding ability of the heat medium and excellent thermal conductivity, which is capable of being produced at low cost, can be provided.

DESCRIPTION OF EMBODIMENTS

In reference to drawings, specific examples of the porous aluminum heat exchanger of the present invention are explained below. Each of embodiments shown below is for specific explanation for the sake of better understanding of the concept of the present invention. Thus, it is not for limiting the present invention unless otherwise specified.

In addition, there is a case where the part corresponding to the main part is shown enlarged for the sake of better understanding of the features of the present invention in drawings used for the explanation for convenience. Thus, dimensional ratio or the like does not match to the real dimensional ratio or the like of each of constituting elements necessarily.

In addition, the word "heat medium" in the following explanations means fluent material (fluid) flowing holding heat, and includes liquid, gaseous body (gas) formed by the liquid being evaporated, mist in which liquid and gas are mixed, and the like when there is no specific explanation.

First Embodiment: Loop Heat Pipe

The loop heat pipe is explained as an example of the porous aluminum heat exchanger of the present invention.

Figure 1:
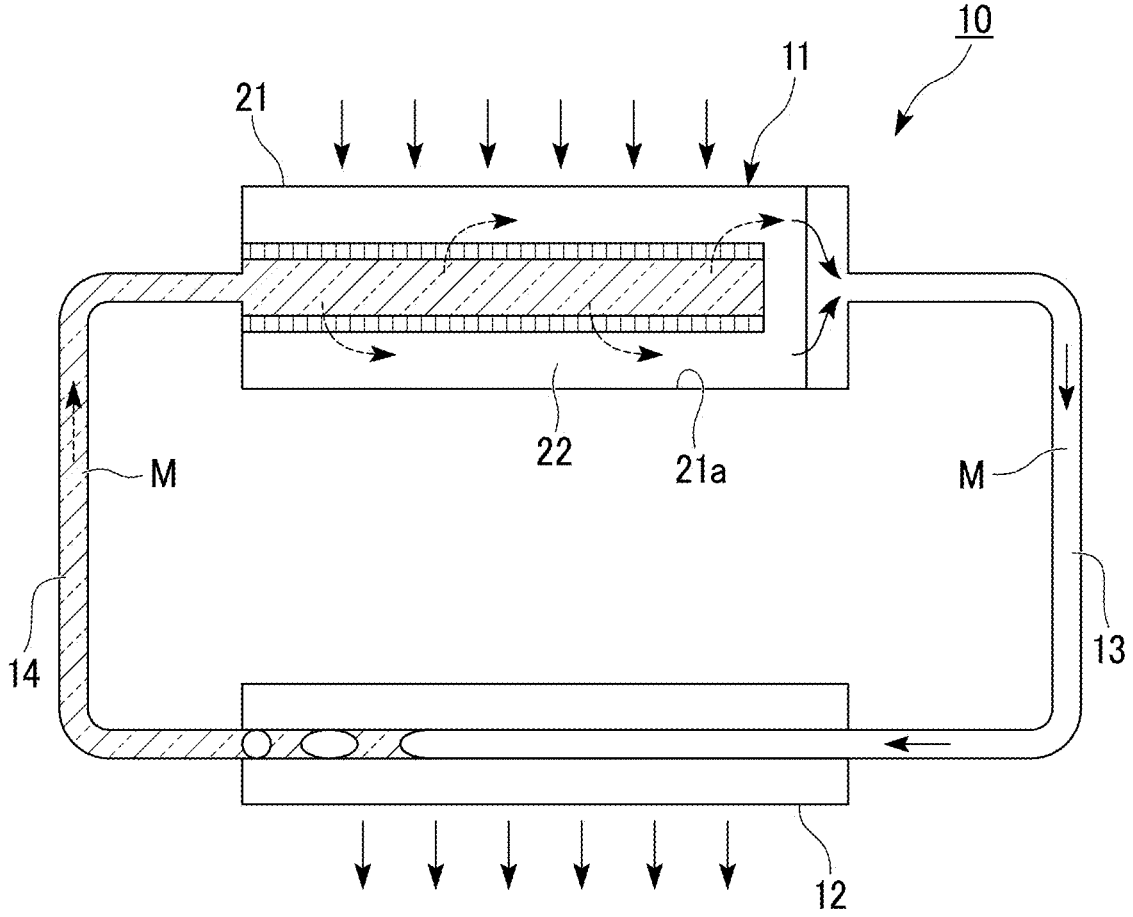
FIG. 1 is a cross-sectional view showing the heat pipe, which is an example of the porous aluminum heat exchanger of the present invention.

FIG. 1 is a cross-sectional view showing the heat pipe, which is an example of the porous aluminum heat exchanger of the present invention.

The loop heat pipe (the porous aluminum heat exchanger) 10 includes: the evaporator 11; the condenser 12; the stem pipe 13 in which the heat medium M is transferred between the evaporator 11 and the condenser 12; and the liquid pipe 14.

The evaporator 11 vaporizes (evaporates) the liquefied heat medium M. In this process, heat is absorbed in the vicinity of the evaporator 11 by the vaporization heat of the heat medium M. The condenser 12 liquefies (condenses) the vaporized heat medium M. In this process, the heat medium M vaporized by the evaporator 11 is sent to the condenser 12 through the steam pipe 13. In addition, the heat medium M liquefied by the condenser 12 is sent to the evaporator 11 through the liquid pipe 14. The heat medium M may be chosen from various heat medium, such as: water; chlorotluorocarbon; alternative chlorofluorocarbon; carbon dioxide; ammonia; and the like, according to the purpose.

By the loop heat pipe 10 configured as explained above, heat exchange can be performed between the evaporator 11 and the condenser 12. More specifically, the circulation cycle, in which heat is absorbed in the evaporator 12 and heat is released in the condenser 12, is formed by circulating the heat medium M between the evaporator 11 and the condenser 12 and repeating evaporation and liquefaction of the heat medium M.

The gas liquid-balance regulator, which is called a reservoir, may be provided on the front side of the evaporator 11.

The evaporator 11 of the loop heat pipe 10 can be used as the heat exchanger that absorbs waste heat of a heat source and cools surrounding environment by vaporization heat, for example.

The evaporator 11 is made of the hollow aluminum pipe (the aluminum bulk body) 21, which is the balk body, and the porous aluminum body 22, which is provided long the inner circumference surface 21*a* of the aluminum pipe (the aluminum bulk body) 21.

The aluminum pipe (the aluminum bulk body) 21 is made of aluminum or aluminum alloy, and constituted from the Al—Mn alloy such as A1070, A3003, and the like; Al—Mg alloy such as A5052 and the like; or the like in the present embodiment. The aluminum pipe 21 is formed by extrusion work, for example, and one having the dimension of; about 5 mm to 150 mm of the outer diameter; about 0.8 mm to 10 mm of the wall thickness, is used, for example.

In the porous aluminum body 22, the aluminum substrates 31 are sintered to be integrated into one-piece. In addition, the specific surface area is set to 0.020 $m^2/g$ or more, and the porosity is set in the range of 30% or more and 90% or less.

Figure 2:
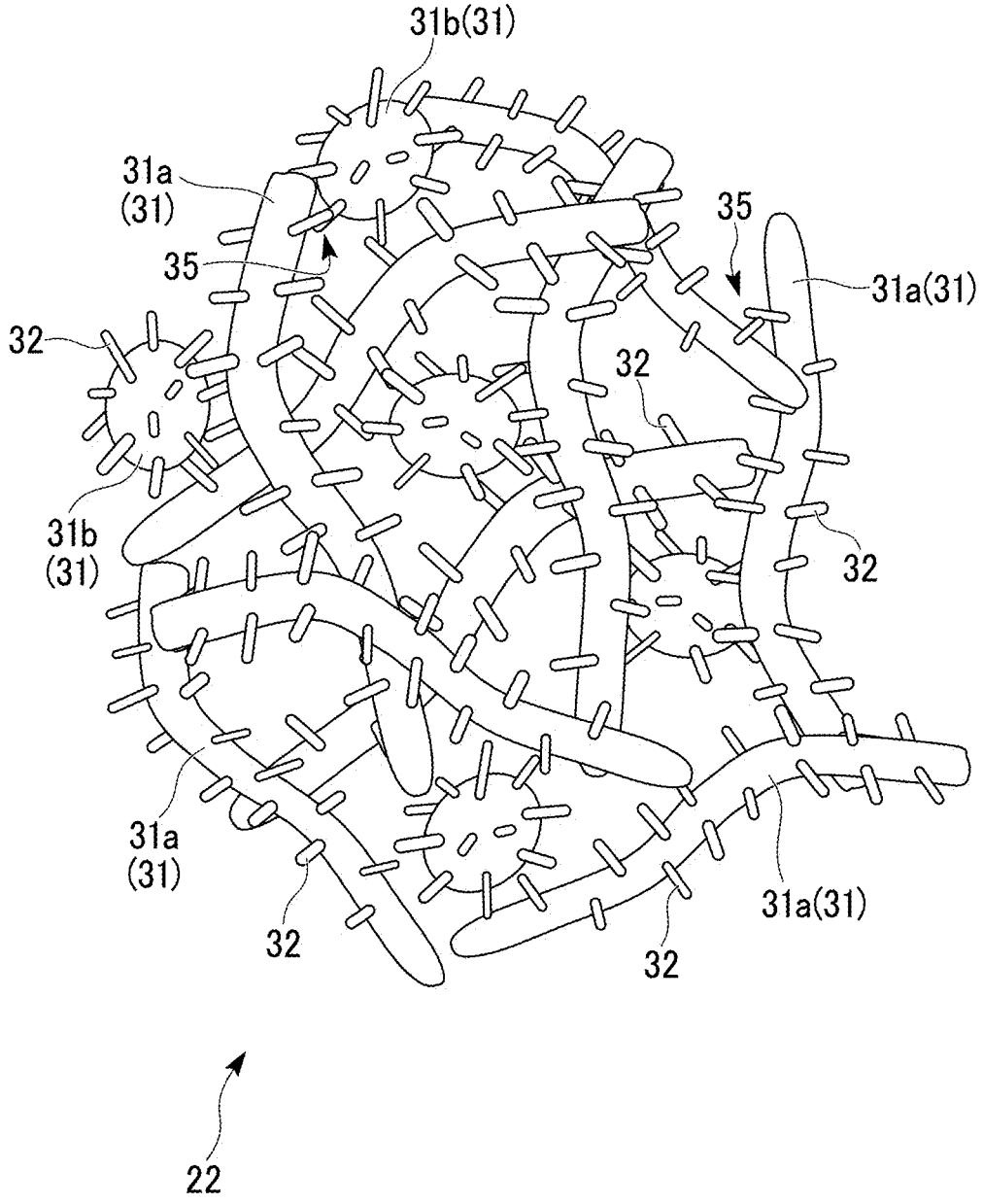
FIG. 2 is an enlarged schematic view of a part of the porous aluminum body of the porous aluminum heat exchanger shown in FIG. 1.

FIG. 2 is a conceptual diagram showing the porous aluminum body 22. For the porous aluminum body 22, the aluminum fibers 31*a* and the aluminum powder 31*b* are sued as the aluminum substrates 31.

The porous aluminum body 22 has the structure, in which the pillar-shaped protrusions 32 projecting toward the outside are formed on the outer surfaces of the aluminum substrates 31 (the aluminum fibers 31*a* and the aluminum powder 31*b*); and the aluminum substrates 31 (the aluminum fibers 31*a* and the aluminum powder 31*b*) are bonded each other through the pillar-shaped protrusions 32. As shown in FIG. 2, the substrate junctions 35 between the aluminum substrates 31, 31 include: a part in which the pillar-shaped protrusions 32, 32 are bonded each other; a part in which the pillar-shaped protrusion 32 and the side surface of the aluminum substrate 31 are bonded each other; and a part in which the side surfaces of the aluminum substrates 31, 31 are bonded each other.

Figure 3:
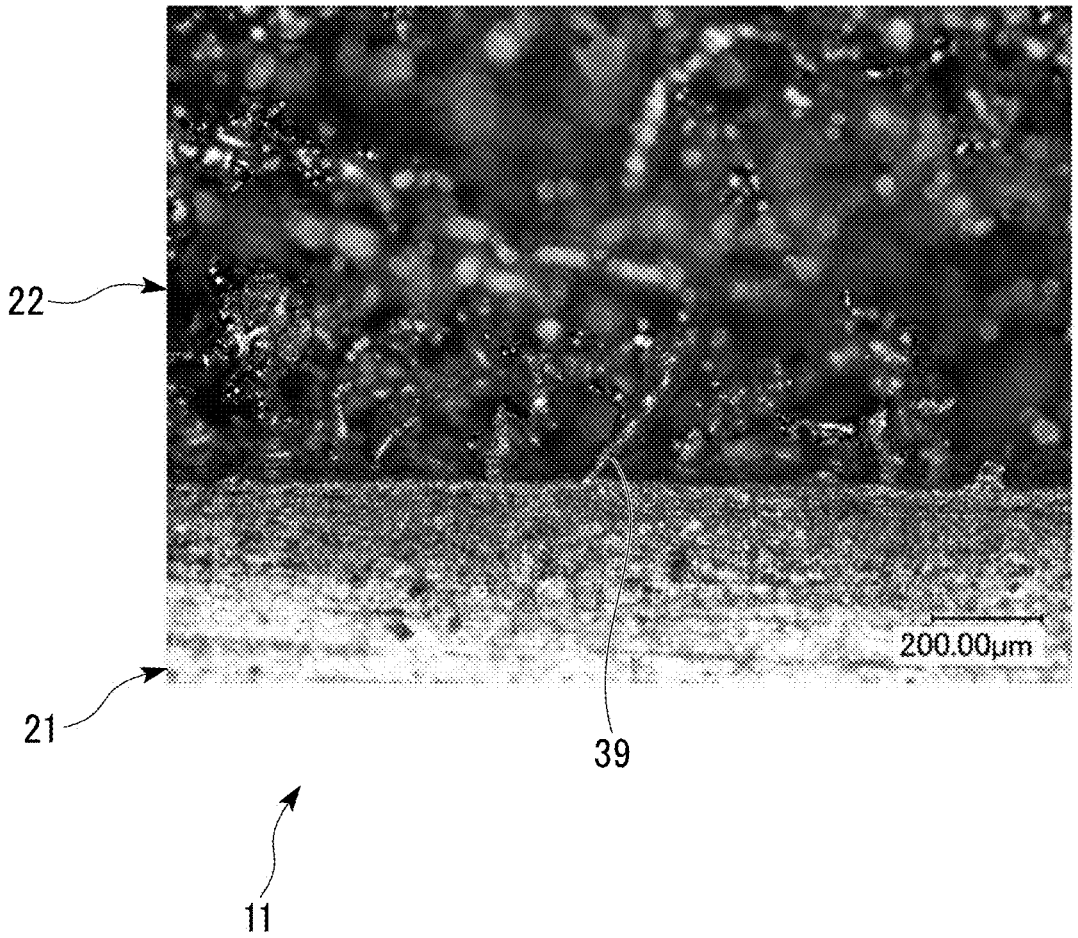
FIG. 3 is an observation photograph of the junction between the porous aluminum body and the aluminum pipe of the porous aluminum heat exchanger shown in FIG. 1.

In the evaporator 11 constituting the loop heat pipe 10 of the present embodiment, pillar-shaped protrusions 32 projecting toward the outside are formed on the outer surfaces of one or both of the aluminum pipe (the aluminum bulk body) 21 and the porous aluminum body 22; and the inner wall surface of the aluminum pipe 21 and the porous aluminum body 22 are bonded through these pillar-shaped protrusions 32, as shown in FIG. 3. In other words, the junctions 39 between the inner wall of the aluminum pipe 21 and the porous aluminum body 22 are formed by the pillar-shaped protrusions 32.

Figure 4:
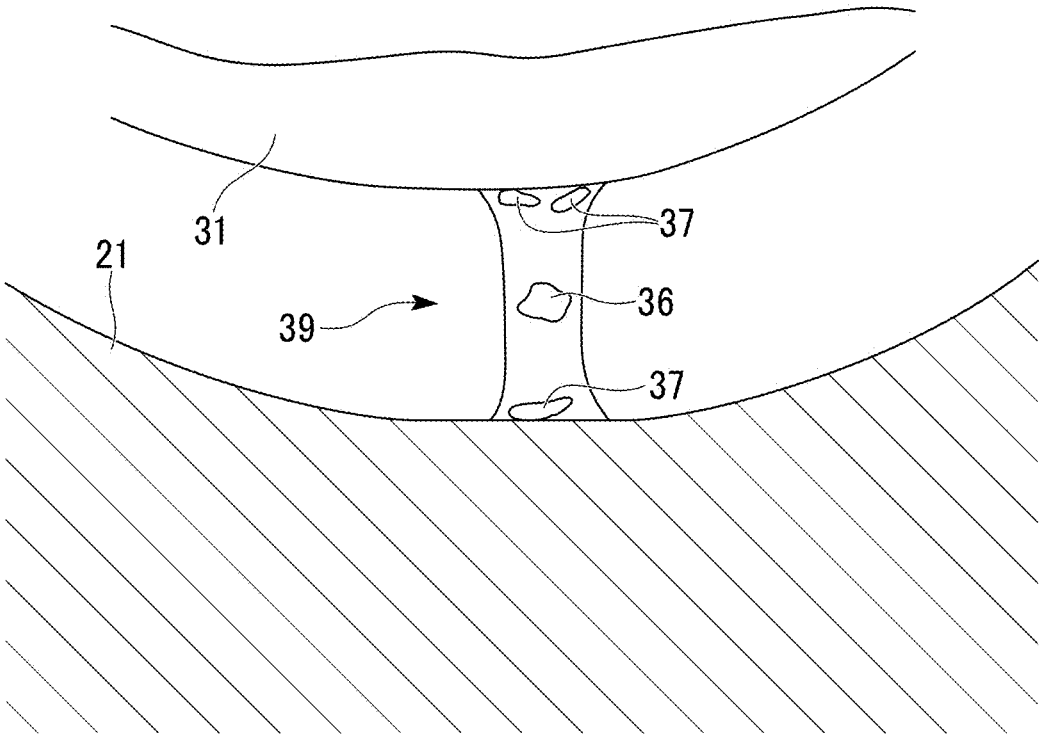
FIG. 4 is a schematic diagram of the junction between the porous aluminum body and the aluminum pipe of the porous aluminum heat exchanger shown in FIG. 1.

The junction 39 between the inner wall of the aluminum pipe 21 and the porous aluminum body 22 bonded through the pillar-shaped protrusions 32 includes the Ti—Al compound 36 and the eutectic element compound 37 including a eutectic element capable of eutectic reaction with Al as shown FIG. 4. The Ti—Al compound 36 is a compound of Ti and Al in the present embodiment as shown in FIG. 4. More specifically, it is $Al_3Ti$ intermetallic compound. In other words, the aluminum substrates 31, 31 are bonded each other in the part where the Ti—Al compound 36 exists in the present embodiment. In other words, the aluminum pipe 21 and the porous aluminum body 22 are bonded in the part including the Ti—Al compound 36 in the present embodiment.

As the eutectic element capable of eutectic reaction with Al, Ag, Au, Ba, Be, Bi, Ca, Cd, Ce, Co, Cu, Fe, Ga, Gd, Ge, In, La, Li, Mg, Mn, Nd, Ni, Pd, Pt, Ru, Sb, Si, Sm, Sn, Sr, Te, Y, Zn, and the like are named, for example. In the present embodiment, the eutectic element compound 37 includes Ni, Mg and Si as the eutectic element as shown in FIG. 4.

In addition, in the porous aluminum body 22, the substrate junctions 35 between the aluminum substrates 31, 31 each other, which are bonded through the pillar-shaped protrusions 32, include the Ti—Al compound and the eutectic element compound including a eutectic element capable of eutectic reaction with Al. In the present embodiment, the Ti—Al compound is a compound of Ti and Al. More specifically, it is $Al_3Ti$ intermetallic compound. In addition, an example, in which the eutectic element compound includes Ni, Mg and Si, is shown. In other words, the aluminum substrates 31, 31 are bonded each other in the part including the Ti—Al compound in the present embodiment.

An example of the method of producing the evaporator 11 constituting the loop heat pipe 10 is explained in reference to FIGS. 5 to 8. First, the aluminum raw material for sintering 40, which is the raw material of the porous aluminum body 22, is explained. The aluminum raw material for sintering 40 includes: the aluminum substrate 31; and the titanium powder grains 42 and the eutectic element powder grains 43 (for example, the nickel powder grains, the magnesium powder grains, the silicon powder grains, or the like), both of which are adhered on the outer surface of the aluminum substrate 31, as shown in FIGS. 6A and 6B.

As the titanium powder grains 42, any one or both of the metal titanium powder grains and the titanium hydride powder grains can be used. As the eutectic element powder grains 43 (for example, the nickel powder grains, the magnesium powder grains, the silicon powder grains, or the like), the metal nickel powder grains; the metal magnesium powder grains; the metal copper powder grains; the metal silicon powder grains; and the like, for example.

In the aluminum raw material for sintering 40, the content amount of the titanium powder grains 42 is set in the range of 0.1 mass % or more and 20 mass % or less. In the present embodiment, it is set to 0.5-10 mass %.

The grain size of the titanium powder grains 42 is set in the range of 1 μm or more and 50 μm or less. Preferably, it is set to 2 μm or more and 30 μm or less. The titanium hydride powder grains can be set to a value finer than that of the metal titanium powder grains. Thus, in the case where the grain size of the titanium powder grains 42 adhered on the outer surface of the aluminum substrate 31 is set to a fine value, it is preferable that the titanium hydride powder grains are used.

Moreover, it is preferable that the distance between the titanium powder grains 42, 22 adhered on the outer surface of the aluminum substrate 31 is set in the range of 5 μm or more and 100 μm or less.

In the aluminum raw material for sintering 40, the content amount of the eutectic element powder grains 43 (for example, the nickel powder grains, the magnesium powder grains, the silicon powder grains, or the like) is in the range of 0.1 mass % or more and 5 mass % or less. In the present embodiment, it is set to 1.0-2.0 mass %.

The grain size of the eutectic element powder grains 43 (for example, the nickel powder grains, the magnesium powder grains, the silicon powder grains, or the like) is set in the range of 0.5 μm or more and 20 μm or less. Preferably, it is set in the range of 1 μm or more and 10 μm or less.

As the aluminum substrate 31, the aluminum fibers 31*a* and the aluminum powder 31*b* are used as described above. As the aluminum powder 31*b*, an atomized powder can be used.

The fiber diameter of the aluminum fiber 31*a* is set in the range of 40 μm or more and 300 μm or less. Preferably, it is set in the range of 50 μm or more and 200 μm or less. The fiber length of the aluminum fiber 31*a* is set in the range of 0.2 mm or more and 20 mm or less. Preferably, it is set in the range of 1 mm or more and 10 mm or less.

The grain size of the aluminum powder 31*b* is set in the range of 10 μm or more and 300 μm or less. Preferably, it is set in the range of 20 μm or more and 100 μm or less.

In addition, the porosity can be controlled by adjusting the mixing rate of the aluminum fibers 31*a* and the aluminum powder 31*b*. More specifically, the porosity of the porous aluminum body 22 can be improved by increasing the ratio of the aluminum fiber 31*a*.

The porosity P of the porous aluminum body 22 is defined by the following formula 1 when: X (g) is the weight of the porous aluminum body 22; Y ($cm^3$) is the volume of the porous aluminum body 22; X/Y=C ($g/cm^3$) is the density of the porous aluminum body 22; and the D ($g/cm^3$) is the density of the aluminum substrates 31.

$$P=(D-C)/D\times 100(\%) \quad \text{(Formula 1)}$$

In the present embodiment, the porosity of the porous aluminum body 22 is set in the range of 30% or more and 90% or less.

In addition, in the present embodiment, the specific surface area of the porous aluminum body 22 is set to 0.020 $m^2/g$ or more. The specific surface area S is defined by the following formula 2 when: V ($cm^3$) is the volume of the porous aluminum body 22; p ($g/cm^3$) is the density of the porous aluminum body 22; and A ($m^2$) is the surface area of the porous aluminum body 22.

$$S=A/(\rho\times V)(m_2/g) \quad \text{(Formula 2)}$$

The larger the specific surface area, the higher the holding ability of the heat medium M.

For adjusting these porosity and the specific surface area, it is preferable that the aluminum fibers 31*a* are used as the aluminum substrates 31. In the case where the aluminum powder 31*b* is mixed in, it is preferable that the ratio of the aluminum powder 31*b* in the aluminum substrates 31 is set to 10-15 mass % or less.

Figure 5:
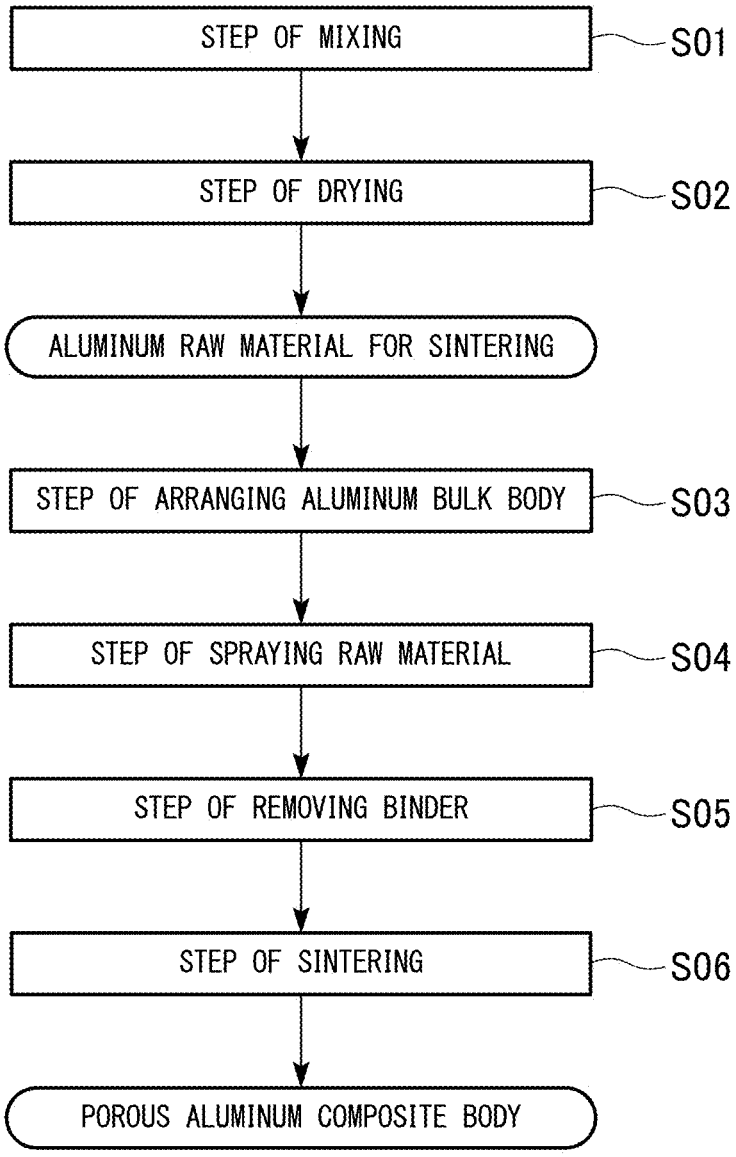
FIG. 5 is a flow chart showing an example of a method of producing the porous aluminum body.

In producing of the evaporator 11 constituting the loop heat pipe 10, the aluminum raw material for sintering 40 is produced as shown in FIG. 5.

The above-described aluminum substrates 31, the titanium powder, and the eutectic element powder (for example, the nickel powder grains, the magnesium powder grains, the silicon powder grains, or the like) are mixed at room temperature (the step of mixing S01). At this time, the binder solution is sprayed on. As the binder, what is burned and decomposed during heating at 500° C. in the air is preferable. More specifically, using an acrylic resin or a cellulose-based polymer material is preferable. In addition, various solvents such as the water-based, alcohol-based, and organic-based solvents can be used as the solvent of the binder.

In the step of mixing S01, the aluminum substrates 31, the titanium powder, and the eutectic element powder (for example, the nickel powder grains, the magnesium powder grains, the silicon powder grains, or the like) are mixed by various mixing machine, such as an automatic mortar, a pan type rolling granulator, a shaker mixer, a pot mill, a high-speed mixer, a V-shaped mixer, and the like, while they are fluidized.

Next, the mixture obtained in the mixing step S01 is dried (the step of drying S02).

Figure 6A:
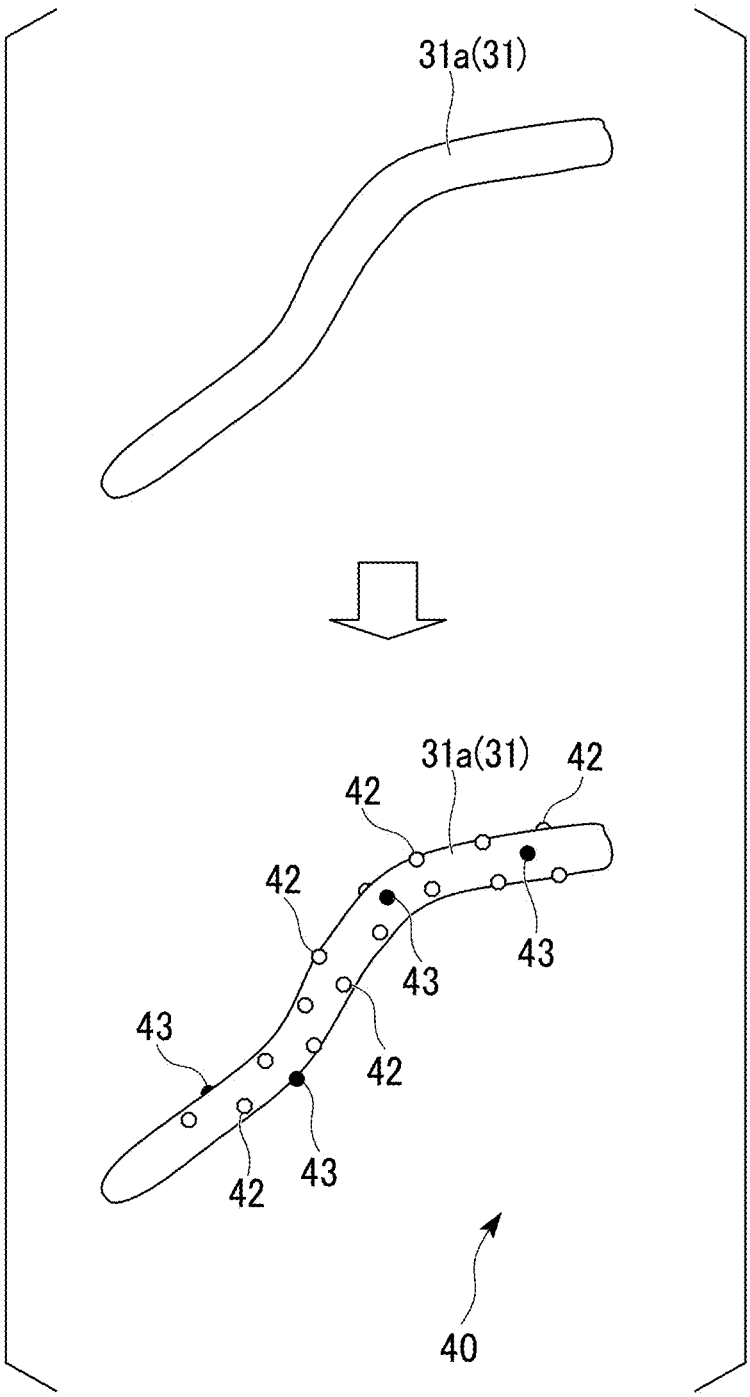
FIG. 6A is an explanatory drawing of the aluminum raw material for sintering in which the titanium powder and the eutectic element powder are adhered on the outer surfaces of the aluminum substrates.
Figure 6B:
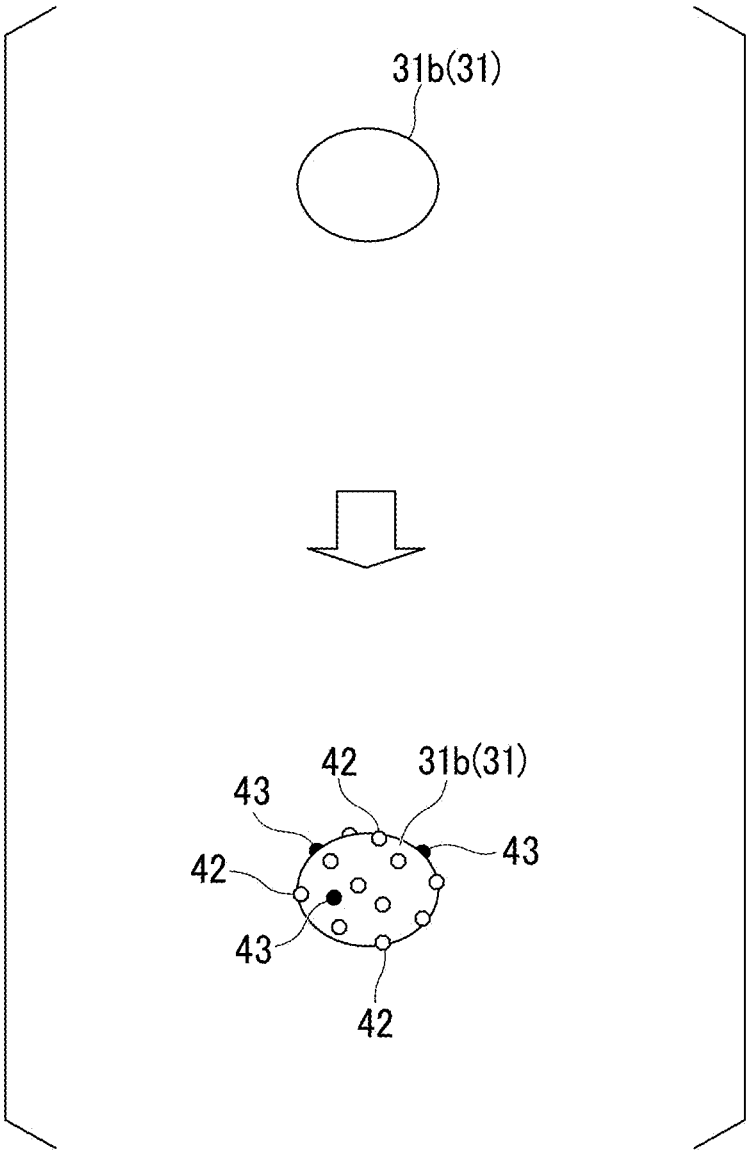
FIG. 6B is an explanatory drawing of the aluminum raw material for sintering in which the titanium powder and the eutectic element powder are adhered on the outer surfaces of the aluminum substrates.

By the mixing step S01 and the drying step S02, the titanium powder grains 42 and the eutectic element powder grain 43 (for example, the nickel powder grains, the magnesium powder grains, the silicon powder grains, or the like) are dispersedly adhered on the surfaces of the aluminum substrates 31 as shown in FIGS. 6A and 6B; and the aluminum raw material for sintering 40 in the present embodiment is produced.

Figure 8:
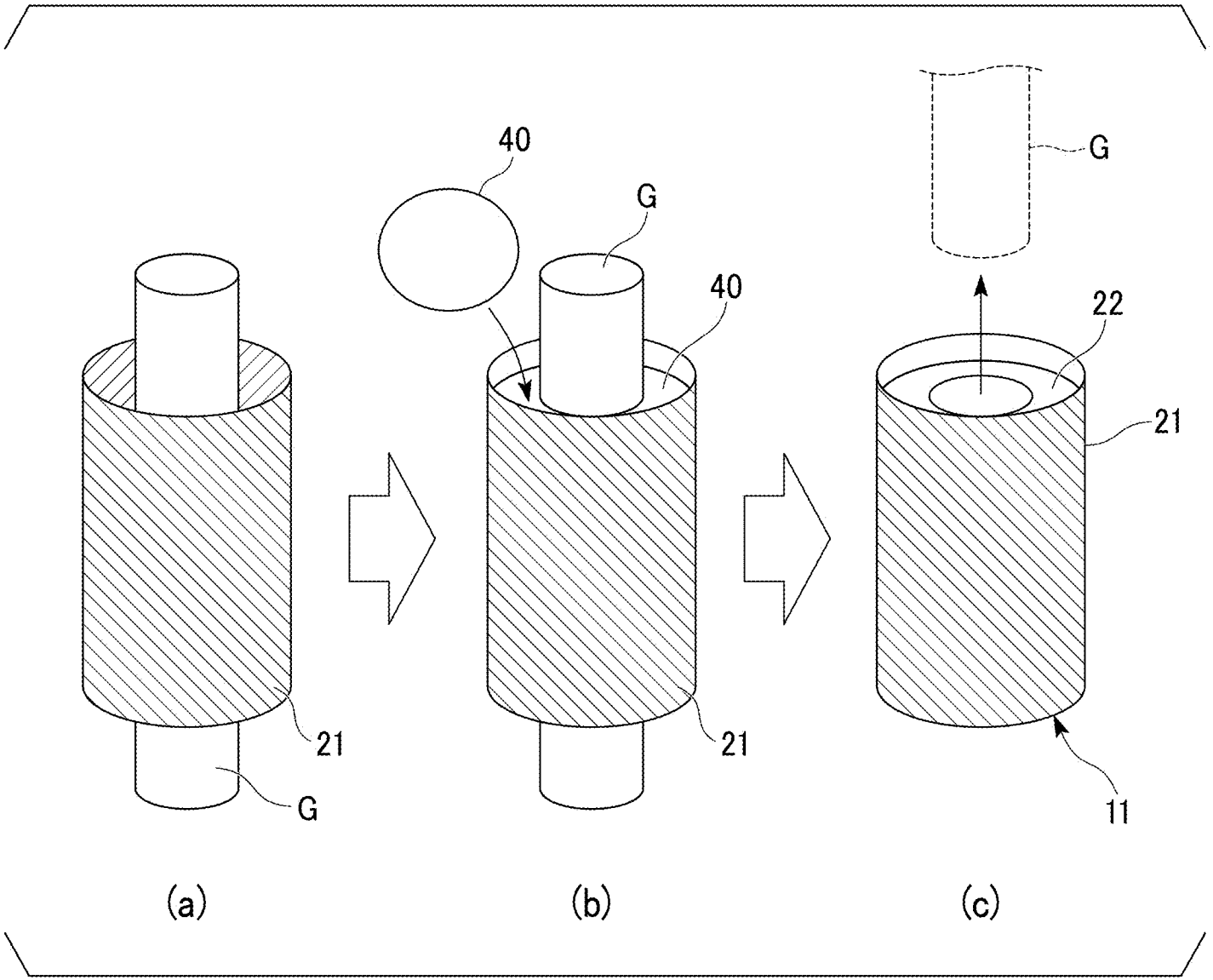
FIG. 8 is a schematic diagram showing the method of producing the evaporator of the porous aluminum heat exchanger shown in FIG. 1.

Next, the aluminum pipe (aluminum bulk body) 21 is arranged as shown in FIG. 8 (*a*), and the jig G in the cylindrical shape is set in such a way that the jig G penetrates through from the one open surface to the other open surface of the aluminum pipe 21 (the step of arranging aluminum bulk body S03). As the jig Gin the cylindrical shape, the material capable of being withdrawn after the step of sintering, which is described later, is chosen. In other words, the material not adhering to the porous aluminum body 22 is chosen. As the jig G, carbon, and tungsten alloy (Anviloy®) can be used, for example.

Next, after closing the other open end of the aluminum pipe 21 appropriately, the aluminum raw material for sintering 40 is sprayed between the inner wall surface of the aluminum pipe 21 and the jig G to bulk fill the space as shown in FIG. 8 (*b*) (the step of spraying raw material S04).

Then, after inserting this into the degreasing furnace, the binder is removed by heating it under air atmosphere (the step of removing binder S05).

Then, it is inserted into the sintering furnace and kept at the temperature range of 600-660° C. for 0.5-60 minutes under an inert gas atmosphere (the step of sintering S06). It is preferable to set the retention time to 1 to 20 minutes.

The dew point can be reduced sufficiently by setting the sintering atmosphere in the step of sintering S06 to the inert gas atmosphere such as Ar gas or the like. The hydrogen atmosphere or the mixed atmosphere of hydrogen and oxygen is not preferable since a reduced dew point is hard to obtain. In addition, nitrogen is not preferable since it reacts with Ti to form TiN for the sintering stimulating effect of Ti to be lost.

In the step of sintering S06, the aluminum substrates 31 in the aluminum raw material for sintering 40 are melted. Since the oxide films are formed on the surfaces of the aluminum substrates 31, the melted aluminum is held by the oxide film; and the shapes of the aluminum substrates 31 are maintained.

In the part where the titanium powder grains 42 are adhered among the outer surfaces of the aluminum substrates 31, the oxide files are destroyed by the reaction with titanium; and the melted aluminum inside spouts out. The spouted out melted aluminum forms a high-melting point compound by reacting with titanium to be solidified.

Figure 7A:
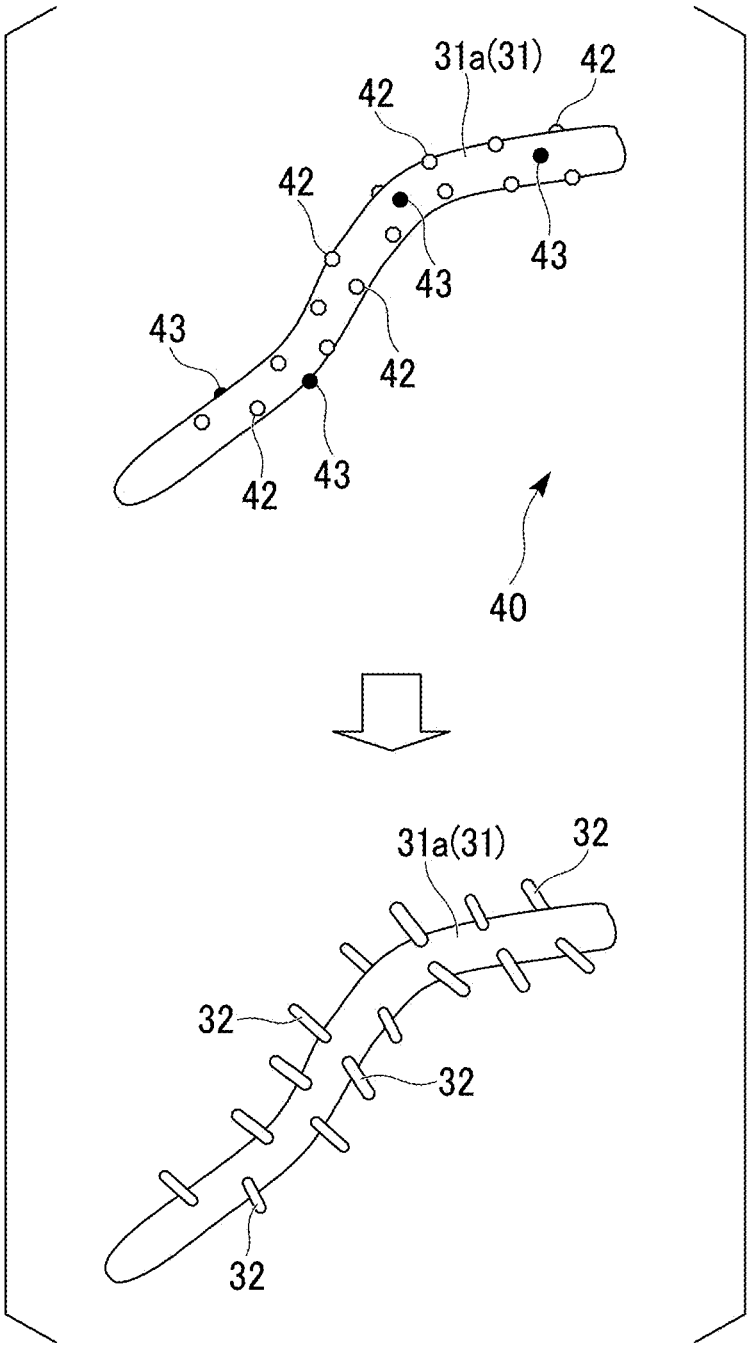
FIG. 7A is an explanatory drawing showing the state where the pillar-shaped protrusions are formed on the outer surface of the aluminum substrate in the step of sintering.
Figure 7B:
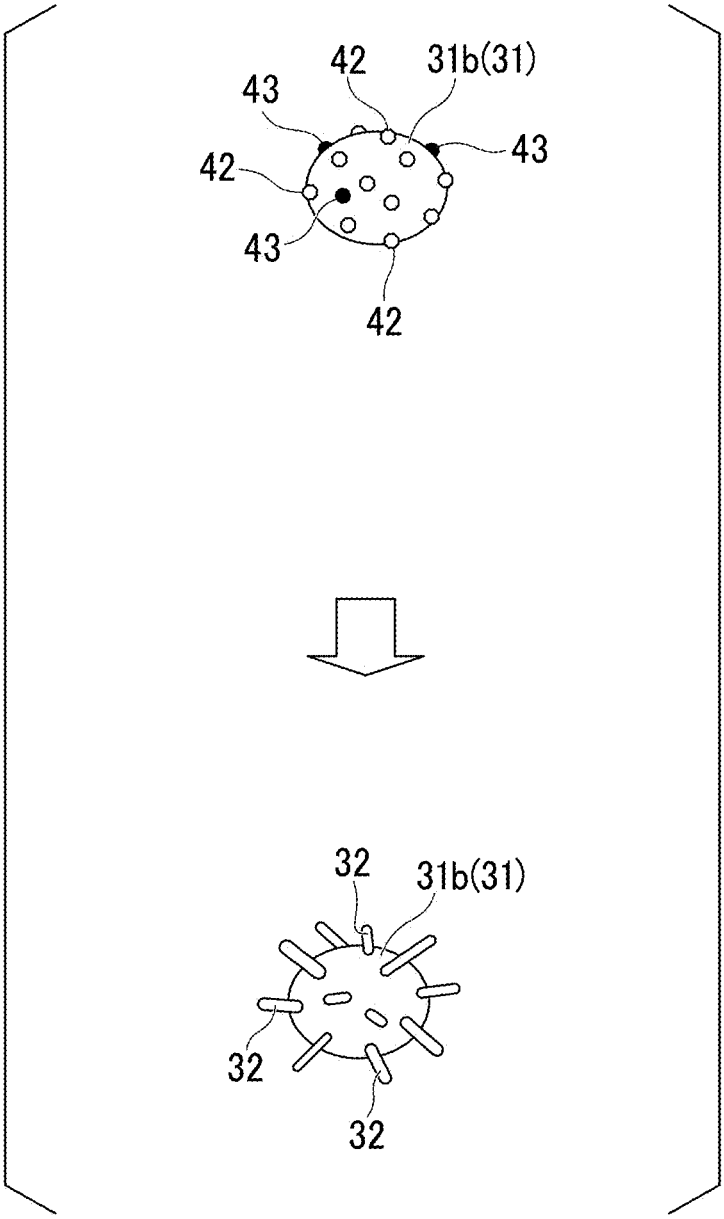
FIG. 7B is an explanatory drawing showing the state where the pillar-shaped protrusions are formed on the outer surface of the aluminum substrate in the step of sintering.

Because of this, the pillar-shaped protrusions 32 projecting toward the outside are formed on the outer surfaces of the aluminum substrates 31 as shown in FIGS. 7A and 7B. On the tip of the pillar-shaped protrusion 32, the Ti—Al compound 36 exists. Growth of the pillar-shaped protrusion 32 is suppressed by the Ti—Al compound 36.

In the case where titanium hydride is used as the titanium powder grains 42, titanium hydride is decomposed near the temperature of 300° C. to 400° C.; and the produced titanium reacts with the oxide films on the surfaces of the aluminum substrates 31.

In addition, in the present embodiment, locations having a lowered melting point are formed locally to the aluminum substrates 31 by the eutectic element powder grains 43 (for example, the nickel powder grains, the magnesium powder grains, the silicon powder grains, or the like) adhered on the outer surfaces of the aluminum substrates 31. Therefore, the pillar-shaped protrusions 32 are formed reliably even in the relatively low temperature condition such as 640° C. to 650° C.

At this time, the adjacent the aluminum substrates 31, 31 are bonded each other by being combined integrally in a molten state or being sintered in a solid state through the pillar-shaped protrusions 32 of each. Accordingly, the porous aluminum body 22, in which the aluminum substrates 31, 31 are bonded each other through the pillar-shaped protrusions 32 as shown in FIG. 2, is produced.

The substrate junction 35, in which the aluminum substrates 31, 31 are bonded each other through the pillar-shaped protrusion 32, includes the Ti—Al compound ($Al_3Ti$ intermetallic compound in the present embodiment) and the eutectic element compound.

Then, the aluminum pipe 21 and the porous aluminum body 22 are bonded through the pillar-shaped protrusions 32 by the pillar-shaped protrusions 32 of the aluminum substrates 31 constituting the porous aluminum body 22 being bonded to the inner wall surface of the aluminum pipe (aluminum bulk body) 21 as shown in FIGS. 3 and 4.

When the titanium grain powder 42 the eutectic element powder grains 43 (for example, the nickel powder grains, the magnesium powder grains, the silicon powder grains, or the like) are provided on the surface of the aluminum pipe 21 to contact thereto, the pillar-shaped protrusions 32 are formed from the surface of the aluminum pipe 21; and the aluminum pipe 21 and the porous aluminum body 22 are bonded.

The junction 39, in which the aluminum pipe 21 and the porous aluminum body 22 are bonded through the pillar-shaped protrusions 32, includes the Ti—Al compound 36 ($Al_3Ti$ intermetallic compound in the present embodiment) and the eutectic element compound 37

Then, the jig G is withdrawn from the porous aluminum body 22 bonded to the aluminum pipe 21 as shown in FIG. 8 (*c*). Because of this, the hollow space in the cylindrical shape in the central part the porous aluminum body 22 is formed. The hollow space functions as the space which the liquefied heat medium M flows in from the liquid pipe 14 when it is used as the evaporator 11 of the loop heat pipe 10.

By following each step described above, the evaporator 11 of the loop heat pipe 10 is obtained.

The outer shape of the jig G may include concavity and convexity in a simple concavo-convex shape or spiral shape, as long as it can be withdrawn after sintering.

According to the loop heat pipe 10 having the above-described evaporator 11, the aluminum substrates 31, 31, in which a number of pillar-shaped protrusions 32 are formed on their surfaces and are bonded through each of the pillar-shaped protrusions 32, are used as the porous aluminum body 22 of the evaporator 11. Thus, the microscopic spaces are formed without increasing the compression ratio to increase the capillary force. Because of this, the liquid absorbency of the porous aluminum body 22 for the heat medium M is increased. Thus, heat exchange can be performed efficiently.

The capillary force is the force absorbing liquid. As an indicator, it is defined by the following formula 3 when: H is the liquid absorption height, Y is the surface area per unit volume of the porous aluminum body 22; Z is the surface tension; θ is the wetting angle of the liquid against aluminum; E is the density of the liquid; P is the porosity of the porous aluminum body 22; and J is the gravitational acceleration.

$$H=Y\times Z\times\cos\theta/E\times P\times J \quad \text{(Formula 3)}$$

In addition, the specific surface area and the porosity of the porous aluminum body 22 can be kept in the range of: 0.020 $m^2/g$ or more; and 30% or more and 90% or less, respectively, since the capillary force is increased without reducing the porosity by increasing the compression ratio of the porous aluminum body 22. Because of this, the holding ability (liquid volume to be retained) of the heat medium M in the porous aluminum body 22 is increased; and heat exchange of a large volume can be performed. If the porosity were less than 30%, the holding ability of the heat medium M would be too low; and it would be possible that sufficient heat transportation (propagation) cannot be performed. If the porosity exceeded 90%, the mechanical strength would become too low; and it would be possible that the porous aluminum body 22 is damaged by impact or the like.

According to the loop heat pipe 10 of the present embodiment, the aluminum substrates 31, 31, in which a number of pillar-shaped protrusions 32 are formed on their surfaces and are bonded through each of the pillar-shaped protrusions 32, are used as the porous aluminum body 22 of the evaporator 11. Thus, the liquid absorbency is increased due to the high capillary force; and high movability of the liquid in the porous aluminum body 22 is obtained.

Because of this, the heat medium M can be absorbed and retained efficiently; and heat exchange can be performed efficiently, without performing the hydrophilic treatment for imparting hydrophilicity to the surface of the porous aluminum body 22. In addition, the cost for performing the hydrophilic treatment is not needed and the loop heat pipe 10 can be produced at low cost, since the porous aluminum body 22 can absorb and retain the heat medium M efficiently without performing the hydrophilic treatment.

In addition, in accordance with the loop heat pipe 10 of the present embodiment, the inner wall surface 21*a* of the aluminum pipe 21 and the porous aluminum body 22 are bonded through the junctions 39. Because of this, heat conduction between the aluminum pipe 21 and the porous aluminum body 22 can be performed efficiently. Thus, the heat absorbing property of the evaporator 11 can be improved; and the loop heat pipe 10 capable of efficient heat exchanging can be obtained.

Second Embodiment: Loop Heat Pipe

In the first embodiment described above, the aluminum pipe 21 and the porous aluminum body 22 constituting the loop heat pipe 10 are bonded each other through the junctions 39. However, it may be configured that the porous aluminum body 22 is placed at the inside of the aluminum pipe 21 free of a specific bonding between the aluminum pipe 21 and the porous aluminum body 22.

Figure 9:
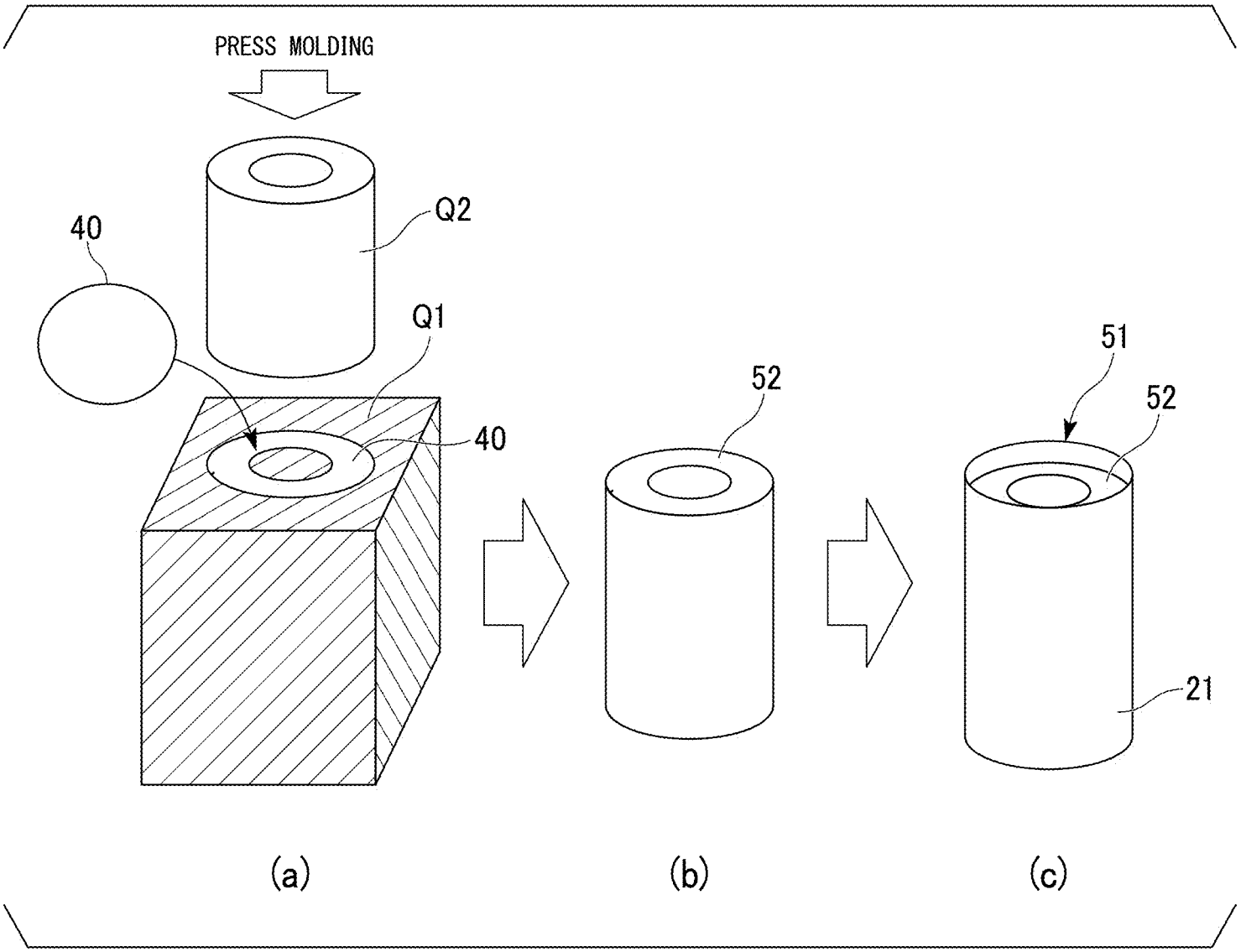
FIG. 9 is a schematic diagram showing the method of producing the porous aluminum heat exchanger of the second embodiment of the present invention.

FIG. 9 is an explanatory drawing showing the method of producing the evaporator constituting the loop heat pipe of the second embodiment of the present invention. Configurations other than the evaporator are the same as the loop heat pipe of the first embodiment.

In producing the evaporator 51 of the loop heat pipe of the second embodiment, first, the mold Q1, which has the hollow molding space in the cylindrical shape, is arranged as shown in FIG. 9 (*a*). Then, the molding space is filled with the aluminum sintering material for sintering 40. Then, press molding is performed by pressing the pressing part Q2 in the shape of molding space to the aluminum raw material for sintering 40 filling the molding space.

Next, the green compact of the press-molded aluminum raw material for sintering 40 is taken out from the mold Q1 (refer FIG. 9 (*a*)) as shown in FIG. 9 (*b*), and inserted in the degreasing furnace to remove the binder by heating under the air atmosphere.

Then, by inserting in the sintering furnace, it is retained in the temperature range of 640-660° C. for 0.5-60 minutes under the inert gas atmosphere. It is preferable that the retention time is 1-20 minutes.

By performing sintering as described above, the pillar-shaped protrusions 32 projecting toward the outside are formed on the outer surfaces of the aluminum substrates 31 as shown in FIGS. 7A and 7B. On the tip of the pillar-shaped protrusion 32, the Ti—Al compound 36 exists. Growth of the pillar-shaped protrusion 32 is suppressed by the Ti—Al compound 36.

In the case where titanium hydride is used as the titanium powder grains 42, titanium hydride is decomposed near the temperature of 300° C. to 400° C.; and the produced titanium reacts with the oxide films on the surfaces of the aluminum substrates 31.

At this time, the adjacent the aluminum substrates 31, 31 are bonded each other by being combined integrally in a molten state or being sintered in a solid state through the pillar-shaped protrusions 32 of each. Accordingly, the porous aluminum body 52, in which the aluminum substrates 31, 31 are bonded each other through the pillar-shaped protrusions 32, is produced.

In addition, correction processing may be performed by inserting the sintered porous aluminum body 52 into a mold.

Next, the porous aluminum body 52 obtained by sintering is inserted to the inside of the aluminum pipe 21, which is the bulk body, to be fixed as shown in FIG. 9 (*c*). By performing this, the evaporator 51 constituting the loop heat pipe of the second embodiment can be obtained.

Third Embodiment: Evaporator and Condenser

Next, the porous aluminum heat exchanger, which uses the multi-port tube of the third embodiment of the present invention, is explained.

Figure 10:
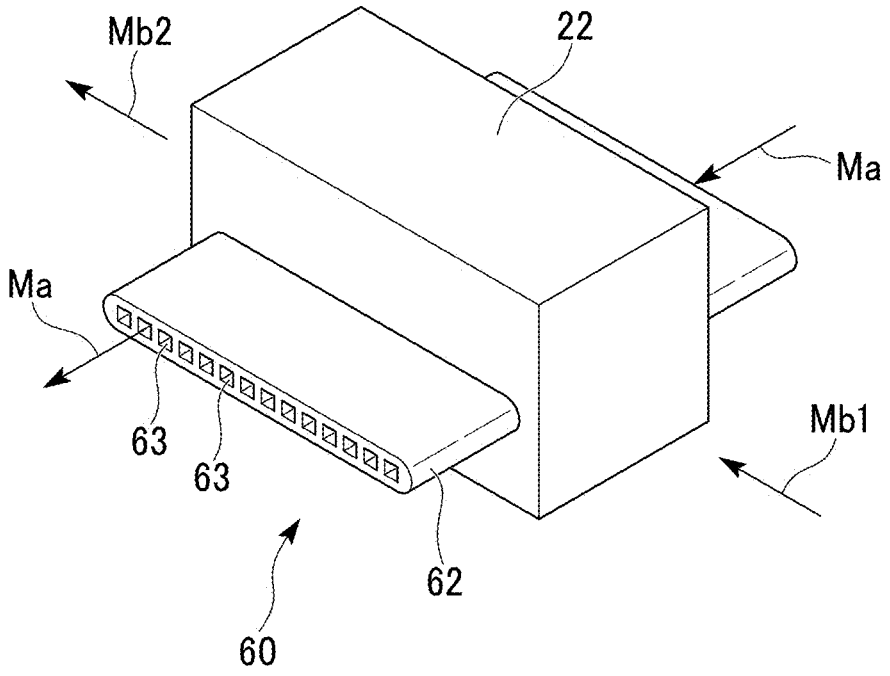
FIG. 10 is an exterior perspective view of the porous aluminum heat exchanger of the third embodiment of the present invention.

FIG. 10 is an enlarged perspective view of the main part showing the porous aluminum heat exchanger of the present invention. The porous aluminum heat exchanger 60 has the structure in which the porous aluminum body 22, which is made of aluminum or aluminum alloy, and the aluminum multi-port tube (aluminum bulk body) 62, which is a bulk body and made of aluminum or aluminum alloy, are bonded.

Describing in detail, the porous aluminum heat exchanger 60 of the present embodiment is used as an evaporator or a condenser, for example, and includes: the aluminum multi-port tube (aluminum bulk body) 62 with the passages, in which the fluid Ma that becomes the first heat medium circulates; and the porous aluminum body 22, which is bonded to at least a part of the outer peripheral surface of the aluminum multi-port tube 62, as shown in FIG. 10.

The aluminum multi-port tube 62 is made of aluminum or aluminum alloy, and constituted from the Al—Mn alloy such as A1070, A3003, and the like; Al—Mg alloy such as A5052 and the like; or the like in the present embodiment. The aluminum multi-port tube 62: is formed by extrusion work, for example; has a flat shape; and includes the multiple through holes 63, 63 . . . , which are passages the fluid Ma circulates therein, as shown in FIG. 10.

In the porous aluminum body 22, the aluminum substrates 31 are sintered to be integrated into one-piece as shown in FIG. 2. In addition, the specific surface area is set to 0.020 $m^2/g$ or more, and the porosity is set in the range of 30% or more and 90% or less. As explained above, as the porous aluminum body 22, one equivalent to the porous aluminum body 22 in the first embodiment is used.

When the porous aluminum heat exchanger 60 configured as described above is used as the evaporator, the porous aluminum body 22 is configured: to include evaporable liquid; the dried fluid Ma1 to circulate around the aluminum multi-port tube 62; and the through holes 63, 63 to be passages of the high temperature fluid Ma.

By having the above-described configuration, the dried fluid Mb1 is converted to the fluid Mb2, which contains evaporated liquid, by the heat of the fluid Ma heating and evaporating the liquid contained in the porous aluminum body 22 through the porous aluminum body 22 while the fluid Ma flows the region on which the porous aluminum body 22 is formed on the aluminum multi-port tube 62. In an example, when the liquid contained in the porous aluminum body 22 is chlorofluorocarbon; the fluid Ma is warm water; and the fluid Mb1 is a dried argon atmosphere, it can be used as the evaporator capable of including the steam of chlorofluorocarbon in the fluid Mb1 by evaporating chlorofluorocarbon (vaporizing).

At this time, the pillar-shaped protrusions 32 shown in FIGS. 7A and 7B behave as boiling nuclei for boiling; and steam can be supplied more efficiently.

On the other hand, when the porous aluminum heat exchanger 60 configured as described above is used as the condenser, the porous aluminum body 22 is configured: to be passages for the high temperature fluid Mb1 including steam; and the through holes 63, 63 of the aluminum multi-port tube 62 to be passages for the low temperature fluid Ma.

By having the above-described configuration, the porous aluminum body 22 is cooled by the fluid Ma; and the steam contained in the fluid Mb is condensed on the surface of the porous aluminum body 22, while the fluid Ma circulates in the region, on which the porous aluminum body 22 is formed, on the aluminum multi-port tube 62. In an example, when the fluid Ma is cooling water; and the steam contained in the fluid Mb is steam of chlorofluorocarbon, it can be used as the condenser in which chlorofluorocarbon is liquefied by the cooling water.

At this time, the pillar-shaped protrusions 32 shown in FIGS. 7A and 7B behave as condensing nuclei for condensing; and steam can be liquefied more efficiently.

Fourth Embodiment: Evaporator and Condenser

Next, the porous aluminum heat exchanger, which uses the multi-port tube of the third embodiment of the present invention, is explained.

Figure 11:
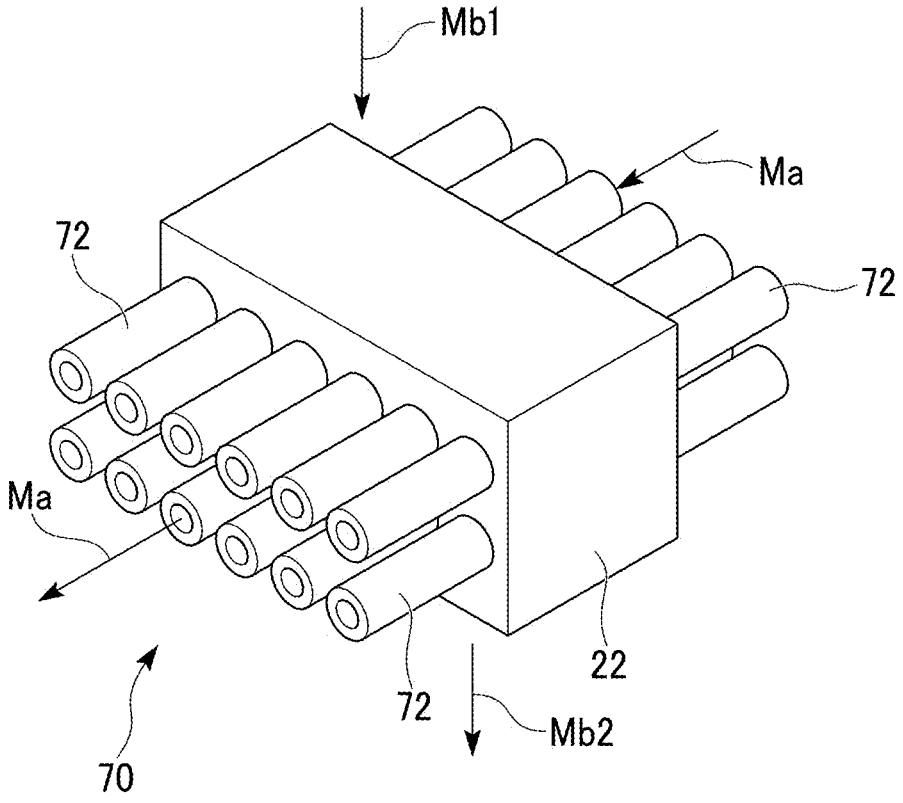
FIG. 11 is an exterior perspective view of the porous aluminum heat exchanger of the fourth embodiment of the present invention.

FIG. 11 is an enlarged perspective view of the main part showing the porous aluminum heat exchanger of the present invention. The porous aluminum heat exchanger 70 has the structure in which the porous aluminum body 22, which is made of aluminum or aluminum alloy, and the multiple aluminum pipes (aluminum bulk body) 72, 72 . . . , which are made of aluminum or aluminum alloy, are bonded.

Describing in detail, the porous aluminum heat exchanger 70 of the present embodiment is used as an evaporator or a condenser, for example, and includes: the multiple aluminum pipes (aluminum bulk body) 72, which are configured to be passages for the fluid Ma and are bulk bodies (two stacks of 6-pipes are arranged in two in FIG. 11); and the porous aluminum body 22, which is bonded to at least a part of the outer peripheral surface of the aluminum pipes 72, as shown in FIG. 11. In other words, 12 aluminum pipes (aluminum bulk body) 72 are formed to penetrate the porous aluminum body in the rectangular parallelepiped shape in FIG. 11.

The aluminum pipes 72, 72 . . . are made of aluminum or aluminum alloy, and constituted from the Al—Mn alloy such as A1070, A3003, and the like; Al—Mg alloy such as A5052 and the like; or the like in the present embodiment.

In the porous aluminum body 22, the aluminum substrates 31 are sintered to be integrated into one-piece as shown in FIG. 2. In addition, the specific surface area is set to 0.020 $m^2/g$ or more, and the porosity is set in the range of 30% or more and 90% or less. As explained above, as the porous aluminum body 22, one equivalent to the porous aluminum body 22 in the first embodiment is used.

When the porous aluminum heat exchanger 70 configured as described above is used as the evaporator, the porous aluminum body 22 is configured: to include evaporable liquid; the dried fluid Ma1 to circulate around the aluminum pipes 72; and the aluminum pipes 72 to be passages of the high temperature fluid Ma.

By having the above-described configuration, the dried fluid Mb1 is converted to the fluid Mb2, which contains evaporated liquid, by the heat of the fluid Ma heating and evaporating the liquid contained in the porous aluminum body 22 through the porous aluminum body 22 while the fluid Ma flows the region on which the porous aluminum body 22 is formed on the aluminum pipes 72. In an example, when the liquid contained in the porous aluminum body 22 is chlorofluorocarbon; the fluid Ma is warm water; and the fluid Mb1 is a dried argon atmosphere, it can be used as the evaporator capable of including the steam of chlorofluorocarbon in the fluid Mb1 by evaporating chlorofluorocarbon (vaporizing).

At this time, the pillar-shaped protrusions 32 shown in FIGS. 7A and 7B behave as boiling nuclei for boiling; and steam can be supplied more efficiently.

On the other hand, when the porous aluminum heat exchanger 70 configured as described above is used as the condenser, the porous aluminum body 22 is configured: to be passages for the high temperature fluid Mb1 including steam; and the aluminum pipes 72 to be passages for the low temperature fluid Ma.

By having the above-described configuration, the porous aluminum body 22 is cooled by the fluid Ma; and the steam contained in the fluid Mb is condensed on the surface of the porous aluminum body 22. In an example, when the fluid Ma is cooling water; and the steam contained in the fluid Mb is steam of chlorofluorocarbon, it can be used as the condenser in which chlorofluorocarbon is liquefied by the cooling water.

At this time, the pillar-shaped protrusions 32 shown in FIGS. 7A and 7B behave as condensing nuclei for condensing; and steam can be liquefied more efficiently.

Fifth Embodiment: Evaporator and Condenser

Next, the porous aluminum heat exchanger, which uses the bent aluminum pipe of the fifth embodiment of the present invention, is explained.

Figure 12:
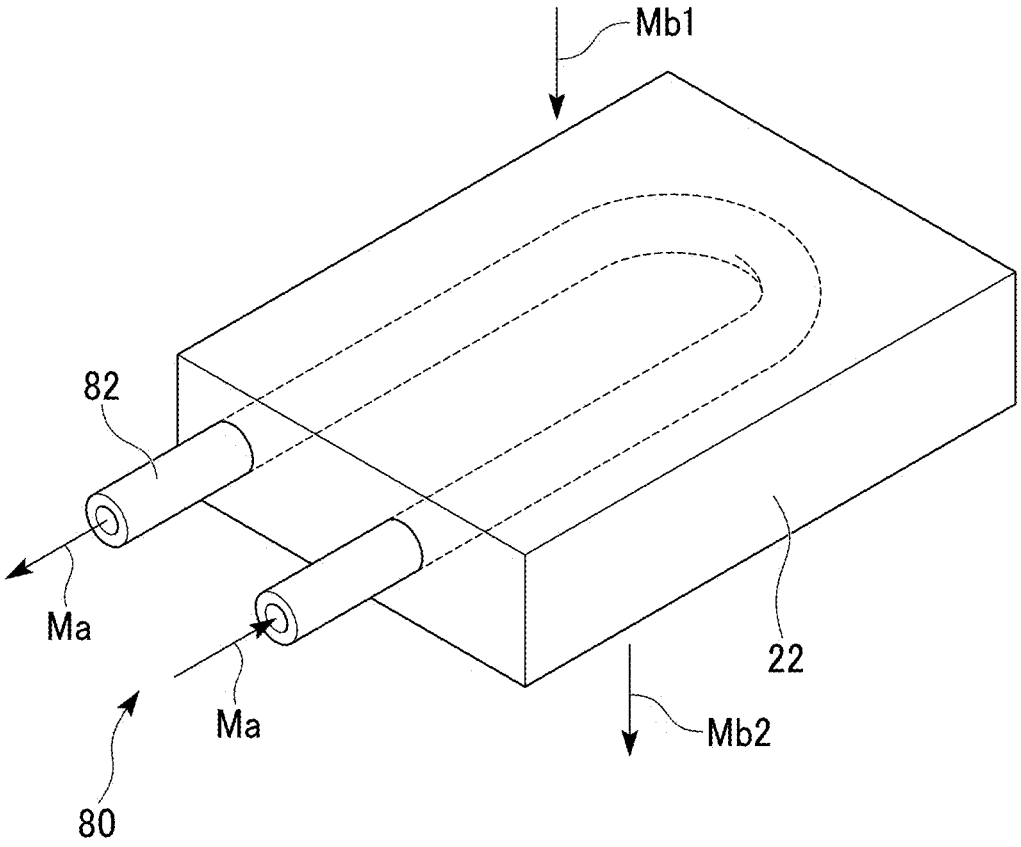
FIG. 12 is an exterior perspective view of the porous aluminum heat exchanger of the fifth embodiment of the present invention.

FIG. 12 is an enlarged perspective view of the main part showing the porous aluminum heat exchanger of the present invention. The porous aluminum heat exchanger 80 has the structure in which the porous aluminum body 22, which is made of aluminum or aluminum alloy, and the bent aluminum pipe (aluminum bulk body) 82, which is a bulk body and made of aluminum or aluminum alloy, are bonded.

Describing in detail, the porous aluminum heat exchanger 80 of the present embodiment is used as an evaporator or a condenser, for example, and includes: the aluminum pipe bent in a U-shape (aluminum bulk body) 82, which is configured to be a passage that the fluid Ma circulates and a bulk body; and the porous aluminum body 22, which is bonded to at least a part of the outer peripheral surface of the bent aluminum pipe 72 including the bent part, as shown in FIG. 12.

By forming the porous aluminum body 22 on the bent part of the bent aluminum pipe 82, the contacting region between the bent aluminum pipe 82 and the porous aluminum body 22 can be increased; and its outer shape can be in a compact shape. The bent aluminum pipe 82 is made of aluminum or aluminum alloy, and constituted from the Al—Mn alloy such as A1070, A3003, and the like; Al—Mg alloy such as A5052 and the like; or the like in the present embodiment.

In the porous aluminum body 22, the aluminum substrates 31 are sintered to be integrated into one-piece as shown in FIG. 2. In addition, the specific surface area is set to 0.020 $m^2/g$ or more, and the porosity is set in the range of 30% or more and 90% or less. As explained above, as the porous aluminum body 22, one equivalent to the porous aluminum body 22 in the first embodiment is used.

When the porous aluminum heat exchanger 80 configured as described above is used as the evaporator, the porous aluminum body 22 is configured: to include evaporable liquid; the dried fluid Ma1 to circulate around the bent aluminum pipe 82 to be the passage of the high temperature fluid Ma.

By having the above-described configuration, the dried fluid Mb1 is converted to the fluid Mb2, which contains evaporated liquid, by the heat of the fluid Ma heating and evaporating the liquid contained in the porous aluminum body 22 through the porous aluminum body 22 while the fluid Ma flows the region on which the porous aluminum body 22 is formed on the bent aluminum pipe 82. In an example, when the liquid contained in the porous aluminum body 22 is chlorofluorocarbon; the fluid Ma is warm water; and the fluid Mb1 is a dried argon atmosphere, it can be used as the evaporator capable of including the steam of chlorofluorocarbon in the fluid Mb1 by evaporating chlorofluorocarbon (vaporizing).

At this time, the pillar-shaped protrusions 32 shown in FIGS. 7A and 7B behave as boiling nuclei for boiling; and steam can be supplied more efficiently.

On the other hand, when the porous aluminum heat exchanger 80 configured as described above is used as the condenser, the porous aluminum body 22 is configured: to be passages for the high temperature fluid Mb1 including steam; and the bent aluminum pipe 82 to be the passage for the low temperature fluid Ma.

By having the above-described configuration, the porous aluminum body 22 is cooled by the fluid Ma; and the steam contained in the fluid Mb is condensed on the surface of the porous aluminum body 22, while the fluid Ma circulates in the region, on which the porous aluminum body 22 is formed, on the bent aluminum pipe 82. In an example, when the fluid Ma is cooling water; and the steam contained in the fluid Mb is steam of chlorofluorocarbon, it can be used as the condenser in which chlorofluorocarbon is liquefied by the cooling water.

At this time, the pillar-shaped protrusions 32 shown in FIGS. 7A and 7B behave as condensing nuclei for condensing; and steam can be liquefied more efficiently.

Sixth Embodiment: Evaporator and Condenser

Next, the porous aluminum heat exchanger, which uses the multi-port tube of the sixth embodiment of the present invention, is explained.

Figure 13A:
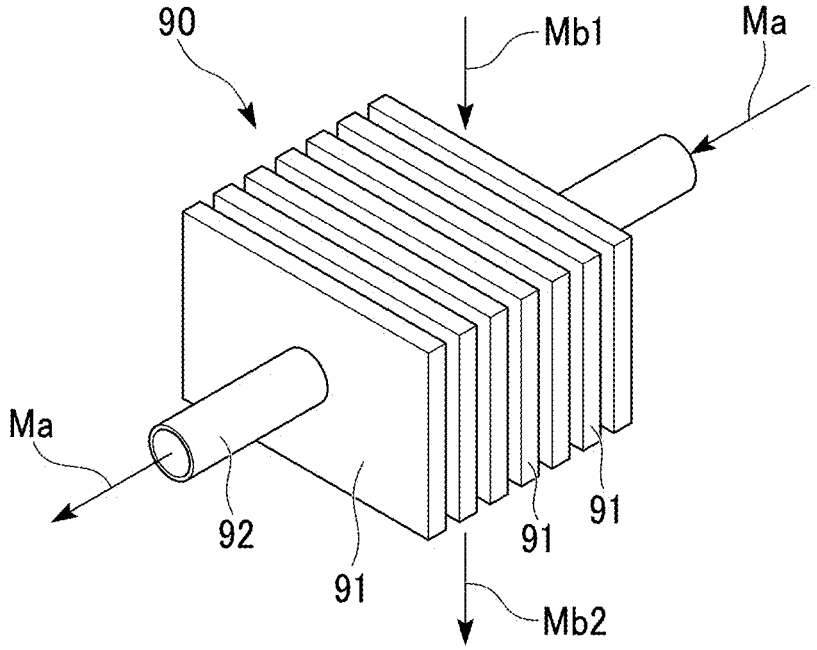
FIG. 13A is an exterior perspective view of the porous aluminum heat exchanger of the sixth embodiment of the present invention.
Figure 13B:
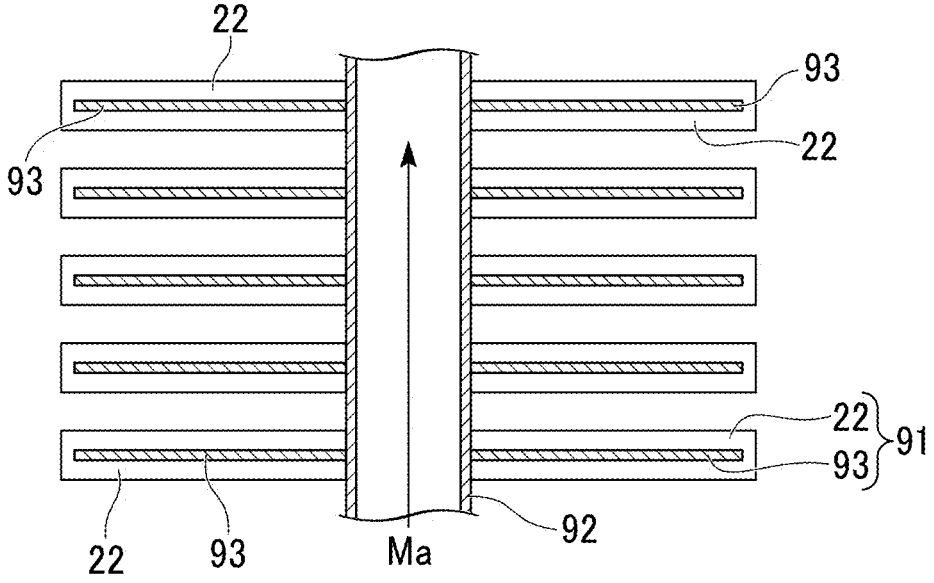
FIG. 13B is a cross-sectional view of the porous aluminum heat exchanger of the sixth embodiment of the present invention along the aluminum pipe.

FIGS. 13A and 13B are a perspective view (FIG. 13A) and a cross-sectional view (FIG. 13B) showing the porous aluminum heat exchanger of the present invention. The porous aluminum heat exchanger 90 is constituted from multiple fins 91, 91 . . . , which are provided in parallel with a predetermined interspace; and the aluminum pipe (aluminum bulk body) 92, which are bulk bodies and formed in such a way to penetrate though the fins 91, 91 . . . . The fins 91, 91 . . . are constituted from the substrate plate (aluminum bulk body) 93 and the porous aluminum body 22 bonded on the surfaces of the substrate plates.

Describing in detail, the porous aluminum heat exchanger 90 of the present embodiment is used as an evaporator or a condenser, for example; the aluminum pipe (aluminum bulk body) 92, which is configured to be the passage of the fluid Ma to be circulated, is provided in such a way that the aluminum pipe 92 penetrates though in the middle of the substrate plates (aluminum bulk body) 93, 93 . . . , which are aligned equally spaced each other and made of aluminum or aluminum alloy; and these substrate plates 93, 93 . . . and the aluminum pipe (aluminum bulk body) 92 are bonded each other.

In addition, the porous aluminum body 22 is bonded in such a way to cover the surfaces of each of the substrate plates 93. The interspaces between the porous aluminum body 22 and each of adjacent porous aluminum bodies 22 become the passages of the fluid Mb circulated in.

In the porous aluminum body 22, the aluminum substrates 31 are sintered to be integrated into one-piece as shown in FIG. 2. In addition, the specific surface area is set to 0.020 $m^2/g$ or more, and the porosity is set in the range of 30% or more and 90% or less. As explained above, as the porous aluminum body 22, one equivalent to the porous aluminum body 22 in the first embodiment is used.

When the porous aluminum heat exchanger 90 configured as described above is used as the evaporator, the porous aluminum body 22 is configured: to include evaporable liquid; the dried fluid Ma1 to circulate around the aluminum pipe 92 to be the passage of the high temperature fluid Ma.

By having the above-described configuration, the dried fluid Mb1 is converted to the fluid Mb2, which contains evaporated liquid, by the heat of the fluid Ma heating and evaporating the liquid contained in the porous aluminum body 22 through the porous aluminum body 22 while the fluid Ma flows the region on which the porous aluminum body 22 is formed on the aluminum pipe 92. In an example, when the liquid contained in the porous aluminum body 22 is chlorofluorocarbon; the fluid Ma is warm water; and the fluid Mb1 is a dried argon atmosphere, it can be used as the evaporator capable of including the steam of chlorofluorocarbon in the fluid Mb1 by evaporating chlorofluorocarbon (vaporizing).

At this time, the pillar-shaped protrusions 32 shown in FIGS. 7A and 7B behave as boiling nuclei for boiling; and steam can be supplied more efficiently.

On the other hand, when the porous aluminum heat exchanger 90 configured as described above is used as the condenser, the porous aluminum body 22 is configured: to be the passage for the high temperature fluid Mb1 including steam; and the aluminum pipe 92 to be the passage for the low temperature fluid Ma.

By having the above-described configuration, the porous aluminum body 22 is cooled through the fluid Ma; and the steam contained in the fluid Mb is condensed on the surface of the porous aluminum body 22, while the fluid Ma circulates in the region of fins 91 of the porous aluminum heat exchanger 90 on the aluminum pipe 92. In an example, when the fluid Ma is cooling water; and the steam contained in the fluid Mb is steam of chlorofluorocarbon, it can be used as the condenser in which chlorofluorocarbon is liquefied by the cooling water.

At this time, the pillar-shaped protrusions 32 shown in FIGS. 7A and 7B behave as condensing nuclei for condensing; and steam can be liquefied more efficiently.

Embodiments of the porous aluminum heat exchanger of the present invention are explained above. However, the present invention is not particularly limited by the explanation of the embodiment, and can be modified within the range of the scope of the present invention as needed.

In addition, in bonding between the porous aluminum body and the aluminum bulk body, examples, in which Ni, Mg or Si is included as the eutectic element compound in the junction, are shown in the embodiments. However, it may be configured for the eutectic element compound to be free of these Ni, Mg and Si, particularly.

In addition, in bonding between the porous aluminum body and the aluminum bulk body, examples, in which they are bonded through the pillar-shaped protrusions, are shown in the embodiments. However, the porous aluminum body and the aluminum bulk body can be bonded by utilizing various bonding methods, such as brazing using brazing material, diffusion bonding, soldering using soldering material, and the like, alternatively, for example.

In addition, examples, in which the porous aluminum body and the aluminum bulk body are bonded, are shown in the embodiments. However, the present invention is not limited by the description, and the material of the bulk body is not limited to aluminum as long as it is a material capable of being bonded in the varieties of methods such as brazing and the like. In addition, in the case where the pipe is only inserted into the porous aluminum body, a bulk body made of any metal or metal alloy can be chosen regardless of its ability to be bonded.

In addition, hydrophilic treatment on the porous aluminum body is not performed particularly in the embodiments. However, by performing the hydrophilic treatment on the porous aluminum body further, the holding ability of the heat medium in the porous aluminum body can be increased further.

Example

Verification results for confirming the effect of the present invention are explained below.

As aluminum bulk bodies for Example of the present invention and a reference example, aluminum pipes made of A1070, A3003 and A5052 having the dimension of: 12 mm of the outer diameter; and 1 mm of the wall thickness, were prepared. Then, porous aluminum bodies having the pillar-shaped protrusions as shown in FIG. 2 on the inside of the aluminum pipes were formed by sintering. The compositions of the porous aluminum bodies are the compositions shown in Table 1. The porosity; the specific surface area; the height of water pulling; and the water retention capability per unit volume were measured on these Examples 1-8 of the present invention and the reference example. Examples 1-3 of the present invention were the examples in which materials of the pipes were varied. Example 4 of the present invention was an example in which the eutectic element in the aluminum sintered material was Mg. Example 5 of the present invention was an example in which the specific surface area was set to a small value. Example 6 was an example in which the hydrophilic treatment was performed. Example 7 of the present invention was an example in which the specific surface area was set to a large value. Example 8 was an example in which the porosity was set to a small value. The reference example was an example in which the specific surface area was set to a value less than 0.020 $m^2/g$.

The measurement of the specific surface area was performed based on the BET (Brunauer-Emmett-Teller) method relying on the low-temperature-low-humidity physical absorption of an inert gas. In the method, a sample was inserted in a glass tube having a constant volume. Then, vacuum degassing was performed at 200° C. for 60 minutes. Then, nitrogen gas was introduced in the glass tube gradually. The specific surface area of each of samples was calculated from the pressure change during the nitrogen gas introduction and the BET method (three point method)

The measurement of the height of water pulling measured by: preparing the porous aluminum body having the dimension of 30 mm×200 mm×5 mm; immersing the porous aluminum body from the water surface in the depth direction of 5 mm, having the direction of 200 mm be the height direction; and measuring the height of water reached after 10 minutes. The water tank used was large enough compared to the size of the porous aluminum body; and the change of the location of the water surface due to the water pulling by the porous aluminum body was negligible.

In the measurement of the water retention capability, the porous aluminum body was immersed in water sufficiently; and the water retention capacity was obtained by dividing the difference of the weights before and after the immersion by the volume of the sintered material.

As aluminum bulk bodies of conventional comparisons, aluminum pipes made of A1070 and having the dimension of: 12 mm of the outer diameter; and 1 mm of the wall thickness, were prepared. Then, the insides of the aluminum pipes were filled with the known aluminum fibers not having the pillar-shaped protrusions. Comparative Example 1 was an example in which the aluminum fibers were subjected to diffusion sintering. Comparative Example 2 was an example in which the aluminum fibers, which were subjected to diffusion sintering, were subjected to hydrophilic treatment. Comparative Example 3 was an example in which the aluminum fibers were compressed and subjected to diffusion sintering. Comparative Example 4 was an example in which the aluminum fibers were only compressed. The porosity; the specific surface area; the height of water pulling; and the water retention capability per unit volume were measured on these Comparative Examples 1-4. The measurement conditions in each measurement were the same as in Example of the present invention.

The verification results in Example of the present invention and Comparative Example are shown in Table 1.

TABLE 1

| | | Pipe material | Aluminum fiber sintered material composition | Porosity (%) | Specific surface area ($m^2/g$) | Water pulling distance (cm) | Water retention capacity per unit volume ($g/cm^3$) | Presence or absence of hydrophilic treatment |
|---|---|---|---|---|---|---|---|---|
| Example of the present invention | 1 | A1070 | Al—5TiH2—1Ni | 71 | 0.051 | 7.2 | 7.0 | Absent |
| | 2 | A3003 | Al—5TiH2—1Ni | 71 | 0.052 | 7.3 | 6.9 | Absent |
| | 3 | A5052 | Al—5TiH2—2Ni | 72 | 0.052 | 7.0 | 7.1 | Absent |
| | 4 | A1070 | Al—5TiH2—1Mg | 73 | 0.061 | 7.8 | 7.2 | Absent |
| | 5 | A1070 | Al—0.5TiH2—1Ni | 71 | 0.025 | 3.5 | 7.0 | Absent |
| | 6 | A1070 | Al—5TiH2—1Ni | 71 | 0.051 | 20 (measurement limit) | 7.0 | Present |
| | 7 | A1070 | Al—10TiH2—1Ni | 67 | 0.091 | 15.4 | 6.8 | Absent |
| | 8 | A1070 | Al—5TiH2—1Ni | 49 | 0.050 | 17.9 | 4.7 | Absent |
| Reference example | | A1070 | Al—0.3TiH2—1Ni | 69 | 0.019 | 2.9 | 6.7 | Absent |
| Comparative Example | 1 | A1070 | Al fiber diffusing sintering | 71 | 0.016 | 2.2 | 6.8 | Absent |
| | 2 | A1070 | Al fiber diffusing sintering | 70 | 0.015 | 12.5 | 6.7 | Present |
| | 3 | A1070 | Al fiber diffusing sintering | 53 | 0.015 | 4.9 | 4.9 | Absent |
| | 4 | A1070 | Al fiber compressed body | 40 | 0.012 | 6.2 | 3.2 | Absent |

According to the verification result shown in Table 1, any one of the porous aluminum heat exchanger of Examples of the present invention had an excellent specific surface area compared to the aluminum heat exchanger of Comparative Examples. In Examples of the present invention without performing the hydrophilic treatment, Example of the present invention had water pulling height higher than Comparative Example, except for Example 5 of the present invention. However, Example 5 of the present invention had a higher water retention capacity per unit volume than Comparative Examples. In addition, Example of the present invention had the water retention capacity per unit volume superior to Comparative Example, except for Example 8 of the present invention. However, Example 8 of the present invention had the water pulling height higher than Comparative Examples. When Example 6 of the present invention and Comparative Example 2, both of which were subjected to the hydrophilic treatment, were compared, Example 6 of the present invention was superior to Comparative Example 6 in all categories of: the specific surface are; the water pulling height; and the water retention capacity per unit volume. Based on these result, it was confirmed that the heat exchanger effectiveness to the heat medium was increased in the porous aluminum heat exchanger of the present invention compared to the conventional heat exchanger.

In addition, it was explained that the aluminum substrates made of pure aluminum were used in the present embodiment. However, the present invention is not particularly limited by description; and aluminum substrates made of general aluminum alloy.

For example, aluminum substrates made of the A3003 alloy (Al—0.6 mass % Si—0.7 mass % Fe—0.1 mass % Cu—1.5 mass % Mn—0.1 mass % Zn alloy), the A5052 alloy (Al—0.25 mass % Si—0.40 mass % Fe—0.10 mass % Cu—0.10 mass % Mn—2.5 mass % Mg alloy—0.2 mass % Cr—0.1 mass % Zn alloy), or the like specified in JIS standards can be suitably used.

In addition, the composition of the aluminum substrates is not limited to one specific kind. It can be appropriately adjusted according to the purpose, such as having the aluminum substrate be a mixture made of pure aluminum fibers; and a powder made of the JIS A3003 alloy, for example.

It was explained that the aluminum bulk body made of aluminum or aluminum alloy, was: Al—Mn alloy such as A1070, A3003 and the like; or Al—Mg alloy such as A5052 and the like, in the present embodiment. However, the present invention is not limited particularly by the description; and other general aluminum alloy can be used freely.

For example, aluminum alloy made of the A2017 alloy (Al—0.8 mass % Si—0.7 mass % Fe—4.5 mass % Cu—1.0 mass % Mn—0.8 mass % Mg—0.1 mass % Cr—0.25 mass % Zn—0.15 mass % Ti alloy), the A7075 alloy (Al—0.4 mass % Si—0.5 mass % Fe—2.0 mass % Cu—0.3 mass % Mn—2.9 mass % Mg—0.28 mass % Cr-6.1 mass % Zn—0.2 mass % Ti alloy) or the like specified in JIS standards can be suitably used.

INDUSTRIAL APPLICABILITY

A high performance heat exchanger can be provided at low cost.

REFERENCE SIGNS LIST

10: Loop heat pipe (porous aluminum heat exchanger)
11: Evaporator
12: Condenser
21: Aluminum pipe (bulk body, aluminum bulk body)
22: Porous aluminum body

What is claimed is:

1. A porous aluminum heat exchanger comprising:

a bulk body made of metal or metal alloy; and a porous aluminum body provided along the inner circumference surface of the bulk body or the outer peripheral surface of the bulk body;

wherein the porous aluminum body comprises aluminum fibers, or a mixture of aluminum fibers and aluminum powder, wherein the aluminum fibers or the aluminum fibers and aluminum powder of the mixture are sintered to each other, each of the aluminum fibers, or the aluminum fibers and aluminum powder particles of the mixture, comprises a plurality of pillar-shaped protrusions projecting from outer surfaces of the aluminum fibers, or the aluminum fibers and aluminum powder particles of the mixture, pores of the porous aluminum body are configured to form flow channels for a heat medium, at least one of the plurality of pillar-shaped protrusions has a tip that is spaced apart from the aluminum fibers or the aluminum fibers and the aluminum powder particles of the mixture, wherein the tip comprises a localized Ti—Al compound, and the at least one of the plurality of pillar-shaped protrusions projects from one of the aluminum fibers, or one of the aluminum fibers and aluminum powder particles of the mixture.

2. The porous aluminum heat exchanger according to claim 1, wherein the bulk body is an aluminum bulk body made of aluminum or aluminum alloy.

3. The porous aluminum heat exchanger according to claim 1, wherein, a specific surface area of the porous aluminum body is 0.020 $m^2/g$ or more, and a porosity of the porous aluminum body is in a range between 30% and 90%.

4. The porous aluminum heat exchanger according to claim 2, wherein, the aluminum bulk body is an aluminum pipe.

5. The porous aluminum heat exchanger according to claim 2, wherein, the porous aluminum body and the aluminum bulk body are bonded to each other by sintering.

6. The porous aluminum heat exchanger according to claim 5, wherein the plurality of pillar-shaped protrusions include at least one junction, the junction bonding at least one of the aluminum fibers or one of the components in the mixture of aluminum fibers and aluminum powder and the aluminum bulk body.

7. The porous aluminum heat exchanger according to claim 2, wherein, a specific surface area of the porous aluminum body is 0.020 $m^2/g$ or more, and a porosity of the porous aluminum body is in a range between 30% and 90%.

8. The porous aluminum heat exchanger according to claim 3, wherein, the aluminum bulk body is an aluminum pipe.

9. The porous aluminum heat exchanger according to claim 7, wherein, the aluminum bulk body is an aluminum pipe.

10. The porous aluminum heat exchanger according to claim 1, wherein, the fiber length of the aluminum fibers is in a range between 0.2 mm and 20 mm.

* * * * *